US012780518B2

(12) United States Patent
Boersma

(10) Patent No.: US 12,780,518 B2
(45) Date of Patent: Nov. 3, 2026

(54) CARTON FOR CONTAINERS

(71) Applicant: Graphic Packaging International, LLC, Atlanta, GA (US)

(72) Inventor: Harmen Boersma, Heerenveen (NL)

(73) Assignee: Graphic Packaging International, LLC, Atlanta, GA (US)

( * ) Notice: Subject to any disclaimer, the term of this patent is extended or adjusted under 35 U.S.C. 154(b) by 29 days.

(21) Appl. No.: 18/597,158

(22) Filed: Mar. 6, 2024

(65) Prior Publication Data

US 2024/0300714 A1 Sep. 12, 2024

Related U.S. Application Data

(60) Provisional application No. 63/451,267, filed on Mar. 10, 2023.

(51) Int. Cl.
*B65D 71/40* (2006.01)

(52) U.S. Cl.
CPC .. *B65D 71/406* (2013.01); *B65D 2571/00141* (2013.01); *B65D 2571/00462* (2013.01);
(Continued)

(58) Field of Classification Search
CPC ..... B65D 71/406; B65D 2571/00141; B65D 2571/00462; B65D 2571/0053; B65D 2571/00574; B65D 2571/00666; B65D 2571/00728; B65D 2571/00814; B65D 2571/00277; B65D 2571/00543; B65D 2571/0066; B65D 71/36; B65D 5/445
USPC .... 229/117.14, 117.13, 199, 117.16, 117.12, 229/920, 244, 103.2; 206/427, 428, 200, 206/141, 162, 806
See application file for complete search history.

(56) References Cited

U.S. PATENT DOCUMENTS 2,594,376 A 4/1952 Arneson
2,810,506 A 10/1957 Kessler
(Continued)

FOREIGN PATENT DOCUMENTS

CA 2 160 145 9/1995
CN 102320400 1/2012
(Continued)

OTHER PUBLICATIONS

International Search Report and Written Opinion for PCT/US2024/018644 dated Jul. 2, 2024.

*Primary Examiner* — Christopher R Demeree
(74) *Attorney, Agent, or Firm* — Andrew N. Claerbout; FisherBroyles, LLP

(57) ABSTRACT

A reinforced carton includes a carton and a reinforcement construct in at least partial face-to-face contact with a portion of the carton. The carton includes a plurality of panels extending at least partially around an interior of the carton, a plurality of end flaps in at least partially overlapping relation to form at least one closed end of the carton, and handle features at least partially forming a handle of the reinforced carton. The reinforcement construct includes a central panel and handle features at least partially forming the handle of the reinforced carton, the handle features of the reinforcement construct including at least one handle reinforcement flap foldably connected to the central panel, the handle features of the carton are aligned with the handle features of the reinforcement construct.

39 Claims, 12 Drawing Sheets

(52) U.S. Cl.
CPC ..... *B65D 2571/0053* (2013.01); *B65D 2571/00574* (2013.01); *B65D 2571/00666* (2013.01); *B65D 2571/00728* (2013.01); *B65D 2571/00814* (2013.01)

(56) References Cited

U.S. PATENT DOCUMENTS 2,868,433 A 1/1959 Anderson, Jr.
2,955,739 A 10/1960 Collura
3,112,856 A 12/1963 MacIntosh et al.
3,127,720 A 4/1964 Gentry et al.
3,309,005 A 3/1967 Pilger
3,886,901 A 6/1975 Zeitter
4,036,423 A 7/1977 Gordon
4,111,306 A 9/1978 Roccaforte
4,216,861 A 8/1980 Oliff
4,318,474 A 3/1982 Hasegawa
4,328,923 A 5/1982 Graser
4,329,923 A 5/1982 Lida
4,364,509 A 12/1982 Holley et al.
4,375,258 A 3/1983 Crayne et al.
4,378,905 A 4/1983 Roccaforte
4,424,901 A 1/1984 Lanier
4,498,619 A 2/1985 Roccaforte
4,546,914 A 10/1985 Roccaforte
4,588,084 A * 5/1986 Holley, Jr. ..... B65D 71/36 206/427
4,747,487 A 5/1988 Wood
5,020,337 A 6/1991 Krieg
5,072,876 A * 12/1991 Wilson ..... B65D 71/36 206/427
5,094,359 A 3/1992 DeMars et al.
5,197,598 A 3/1993 Stout et al.
5,246,112 A 9/1993 Stout et al.
5,284,294 A 2/1994 Floyd
5,292,058 A 3/1994 Zoss et al.
5,297,725 A * 3/1994 Sutherland ..... B65D 71/36 229/920
5,303,863 A 4/1994 Arasim
5,307,966 A 5/1994 Schuster
5,385,234 A * 1/1995 Stout ..... B65D 5/54 206/427
5,427,241 A 6/1995 Sutherland
5,480,091 A * 1/1996 Stout ..... B65D 71/36 229/920
5,495,727 A 3/1996 Strong et al.
5,551,556 A 9/1996 Sutherland
5,582,343 A 12/1996 Dalvey
5,639,017 A 6/1997 Fogle
5,699,957 A 12/1997 Blin et al.
5,704,470 A 1/1998 Sutherland
5,794,778 A 8/1998 Harris
5,826,782 A 10/1998 Stout
5,873,515 A 2/1999 Dunn et al.
5,915,546 A 6/1999 Harrelson
5,992,733 A 11/1999 Gomes
6,065,590 A 5/2000 Spivey
6,105,853 A 8/2000 Lamare
6,105,854 A 8/2000 Spivey et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,523,739 B2 2/2003 Heeley et al.
6,631,803 B2 10/2003 Rhodes et al.
6,758,337 B2 7/2004 Chargueraud et al.
6,926,193 B2 8/2005 Smalley
7,427,010 B2 9/2008 Sutherland
7,601,111 B2 10/2009 Sutherland et al.
7,806,314 B2 10/2010 Sutherland et al.
8,070,052 B2 12/2011 Spivey et al.
8,191,761 B2 6/2012 Brand
8,216,118 B2 7/2012 Dunn
8,348,142 B2 1/2013 Smalley
8,356,743 B2 1/2013 Spivey
8,356,744 B2 1/2013 Brand et al.
8,376,214 B2 2/2013 Spivey et al.
8,387,855 B2 3/2013 Brand
8,439,194 B2 5/2013 Spivey
8,459,533 B2 6/2013 Requena
8,727,204 B2 5/2014 Burke
8,840,009 B2 9/2014 Spivey et al.
8,955,736 B2 2/2015 Spivey et al.
8,967,380 B2 3/2015 Moncrief et al.
8,978,889 B2 3/2015 Fitzwater et al.
9,010,620 B2 4/2015 Sutherland et al.
9,022,217 B2 5/2015 Holley
9,033,209 B2 5/2015 Fogle et al.
9,073,658 B2 7/2015 Spivey et al.
9,073,663 B2 7/2015 Holley
9,126,716 B2 9/2015 Kohler et al.
9,187,206 B2 11/2015 Holley
9,199,774 B2 12/2015 Smalley et al.
9,205,939 B2 12/2015 Disrud et al.
9,248,933 B2 2/2016 Spivey et al.
9,284,084 B2 3/2016 Schmal et al.
9,334,093 B2 5/2016 Holley
9,376,230 B2 6/2016 Kastanek et al.
9,394,094 B2 7/2016 Holley et al.
9,487,320 B2 11/2016 Holley
9,511,894 B2 12/2016 Wilson et al.
9,540,159 B2 1/2017 Boersma et al.
9,598,202 B2 3/2017 Oliveira et al.
9,598,214 B2 3/2017 Holley
9,636,882 B2 5/2017 Holley
9,701,436 B2 7/2017 Holley
9,708,112 B2 7/2017 Sutherland
9,718,246 B2 8/2017 Holley et al.
9,776,750 B2 10/2017 May et al.
9,840,358 B2 12/2017 Oliveira
9,963,262 B2 5/2018 Smalley
D826,711 S 8/2018 Boersma et al.
10,059,485 B2 8/2018 Spivey et al.
10,322,844 B2 6/2019 Boersma et al.
10,322,845 B2 6/2019 Boersma et al.
D854,412 S 7/2019 Smalley
D867,900 S 11/2019 Thompson
10,513,367 B2 12/2019 Smalley et al.
10,513,369 B2 12/2019 Holley et al.
10,513,381 B2 12/2019 Nielsen et al.
10,549,875 B2 2/2020 Spivey et al.
D881,690 S 4/2020 Smalley
D885,887 S 6/2020 Thompson
10,737,824 B2 8/2020 Fitzwater et al.
D898,565 S 10/2020 Kearns et al.
10,906,690 B2 2/2021 Holley
11,142,383 B2 10/2021 Thompson
11,254,465 B2 2/2022 Ford
11,305,924 B2 4/2022 Smalley
11,325,764 B2 5/2022 Spivey et al.
D966,098 S 10/2022 Gonzalez Manzano
D993,016 S 7/2023 Holley
11,912,484 B2 2/2024 Gonzalez Manzano
12,006,116 B2 6/2024 Smalley
12,071,290 B2 8/2024 Thompson
12,269,656 B2 4/2025 Holley
2003/0006158 A1 1/2003 Skolik et al.
2003/0213263 A1 11/2003 Woog
2006/0169755 A1 8/2006 Spivey
2006/0273143 A1 12/2006 Finch
2007/0051781 A1 3/2007 Holley, Jr.
2007/0164091 A1 7/2007 Fogle et al.
2007/0181658 A1 8/2007 Sutherland
2007/0290026 A1 12/2007 Kastanek et al.
2009/0127147 A1 5/2009 Sutherland
2009/0250357 A1 10/2009 Spivey
2009/0255983 A1 10/2009 DePaula et al.
2009/0277954 A1 11/2009 DePaula et al.
2010/0051677 A1 3/2010 Chen
2010/0078337 A1 4/2010 Sutherland et al.
2010/0140337 A1 6/2010 Brand
2011/0162408 A1 7/2011 Brand
2011/0226845 A1 9/2011 DePaula et al.
2012/0012600 A1 1/2012 Gonzalez

(56) References Cited

U.S. PATENT DOCUMENTS

| | | | |
|---|---|---|---|
| 2012/0193404 | A1 | 8/2012 | Eckermann et al. |
| 2014/0332429 | A1 | 11/2014 | Boersma et al. |
| 2015/0266640 | A1 | 9/2015 | Thompson |
| 2016/0101918 | A1 | 4/2016 | Bates et al. |
| 2016/0347522 | A1 | 12/2016 | Skolik |
| 2017/0137165 | A1 | 5/2017 | Holley |
| 2017/0320648 | A1 | 11/2017 | Droege |
| 2023/0031526 | A1 | 2/2023 | Holley et al. |
| 2024/0150100 | A1 | 5/2024 | Holley |
| 2024/0300714 | A1 | 9/2024 | Boersma |
| 2024/0375839 | A1 | 11/2024 | Boersma |

FOREIGN PATENT DOCUMENTS

| | | |
|---|---|---|
| DE | 8514718.4 | 6/1985 |
| EP | 3118135 | 1/2017 |
| KR | 10-1520822 | 5/2015 |
| WO | WO 2005/080218 A1 | 9/2005 |
| WO | WO 2007/089282 | 8/2007 |
| WO | WO 2010/107873 | 9/2010 |
| WO | WO 2012/116027 | 8/2012 |
| WO | WO 2014/130788 | 8/2014 |
| WO | WO 2018/141007 | 8/2018 |
| WO | WO 2024/191687 | 9/2024 |

* cited by examiner

CARTON FOR CONTAINERS

CROSS-REFERENCE TO RELATED APPLICATION

The present application claims the benefit of U.S. Provisional Patent Application No. 63/451,267, filed on Mar. 10, 2023.

INCORPORATION BY REFERENCE

The disclosure of U.S. Provisional Patent Application No. 63/451,267, filed on Mar. 10, 2023, is hereby incorporated by reference for all purposes as if set forth in its entirety.

BACKGROUND

The present disclosure generally relates to cartons for holding beverage containers or other types of articles. More specifically, the present disclosure relates to cartons configured with handle features that facilitate even stress distribution across portions of the carton when carried by a user.

SUMMARY OF THE DISCLOSURE

According to one aspect, the disclosure is generally directed to a reinforced carton comprising a carton and a reinforcement construct in at least partial face-to-face contact with a portion of the carton. The carton comprises a plurality of panels extending at least partially around an interior of the carton, the plurality of panels comprising a top panel, a bottom panel, a front panel, and a back panel, a plurality of end flaps foldably connected to a respective panel of the plurality of panels of the carton and in at least partially overlapping relation to form at least one closed end of the carton, and handle features at least partially forming a handle of the reinforced carton. The reinforcement construct comprises a central panel, and handle features at least partially forming the handle of the reinforced carton, the handle features of the reinforcement construct comprising at least one handle reinforcement flap foldably connected to the central panel, the handle features of the carton are aligned with the handle features of the reinforcement construct.

According to another aspect, the disclosure is generally directed to a combination of blanks for forming a reinforced carton, the combination of blanks comprising a carton blank for forming a carton and a reinforcement blank for forming a reinforcement construct for being in at least partial face-to-face contact with a portion of the carton formed from the carton blank. The carton blank comprises a plurality of panels for extending at least partially around an interior of the carton formed from the carton blank, the plurality of panels comprising a top panel, a bottom panel, a front panel, and a back panel, a plurality of end flaps foldably connected to a respective panel of the plurality of panels of the carton blank and for being positioned in at least partially overlapping relation to form at least one closed end of the carton formed from the carton blank, and handle features at least partially forming a handle of the reinforced carton formed from the combination of blanks. The reinforcement blank comprises a central panel and handle features at least partially forming the handle of the reinforced carton formed from the combination of blanks, the handle features of the reinforcement blank comprising at least one handle reinforcement flap foldably connected to the central panel, the handle features of the carton blank are for being aligned with the handle features of the reinforcement blank when the reinforced carton is formed from the combination of blanks.

According to another aspect, the disclosure is generally directed to a method of forming a reinforced carton, the method comprising obtaining a carton blank comprising a plurality of panels comprising a top panel, a bottom panel, a front panel, and a back panel, a plurality of end flaps foldably connected to a respective panel of the plurality of panels of the carton blank, and handle features. The method further comprises obtaining a reinforcement blank comprising a central panel and handle features comprising at least one handle reinforcement flap foldably connected to the central panel. The method further comprises folding the plurality of panels of the carton blank at least partially around an interior of the reinforced carton, forming a reinforcement construct from the construct blank, positioning the reinforcement construct in at least partial face-to-face contact with a portion of the carton, aligning the handle features of the carton with the handle features of the reinforcement construct to form a handle of the reinforced carton, and at least partially overlapping the plurality of end flaps of the carton blank to form at least one closed end of the reinforced carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to cartons that contain articles, for example, containers such as bottles, cans, etc. The articles can be used, for example, for packaging food and beverage products. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

As described herein, cartons may be formed by multiple overlapping panels and/or end flaps. Such panels and/or end flaps may be designated in relative terms to one another, e.g., "first", "second", "third", etc., in sequential or non-sequential reference, without departing from the disclosure.

Figure 1:
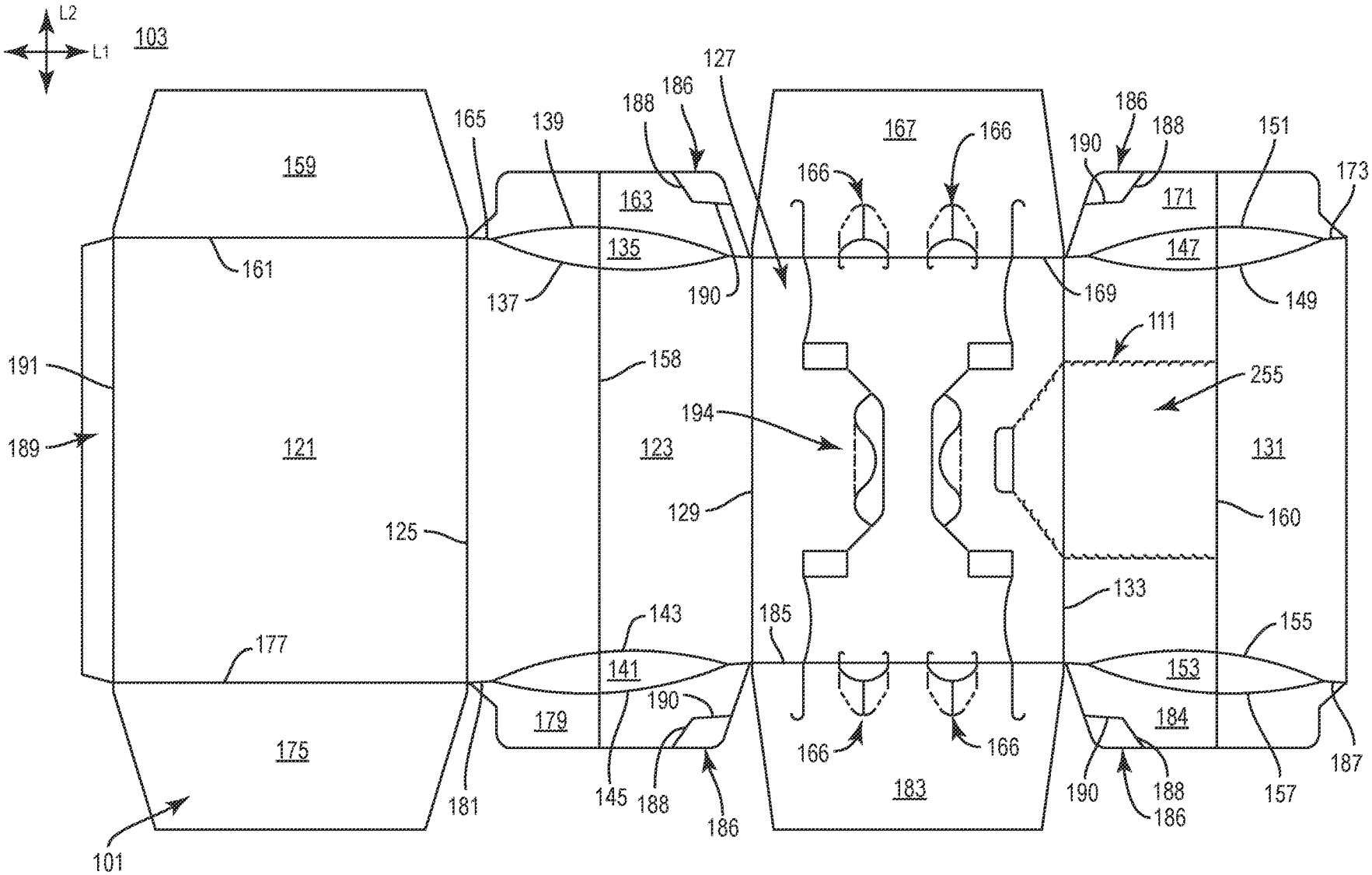
FIG. 1 is a plan view of an exterior surface of a carton blank for forming a carton according to a first exemplary embodiment of the disclosure.
Figure 1A:
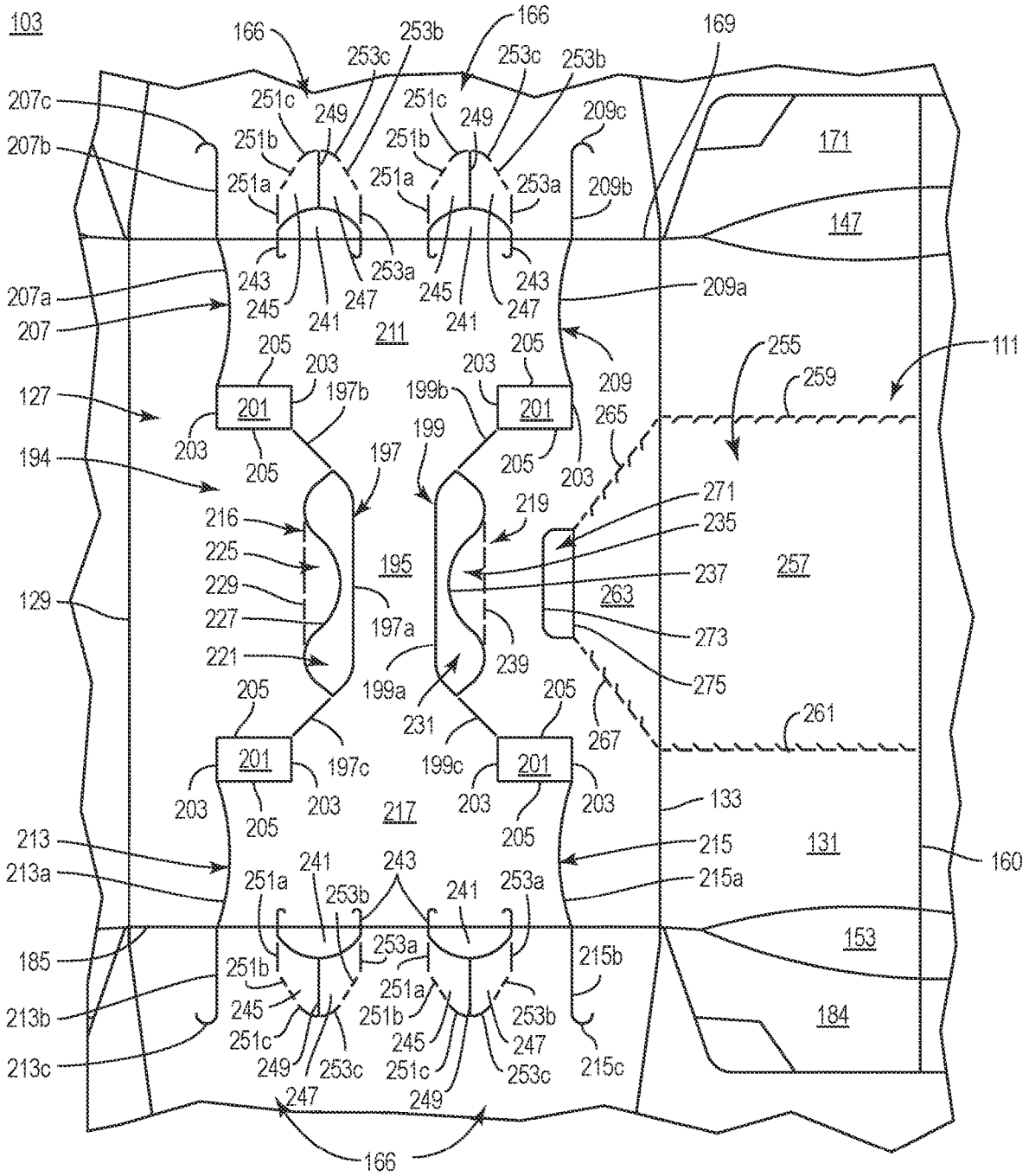
FIG. 1A is an enlarged view of a portion of the blank of FIG. 1.

FIG. 1 shows a plan view of the exterior surface 101 of a first blank or carton blank, generally indicated at 103, that can be obtained to form a carton 105 (FIG. 4) according to a first exemplary embodiment of the disclosure. FIG. 1A is an enlarged view of a portion of the blank 103.

Figure 10:
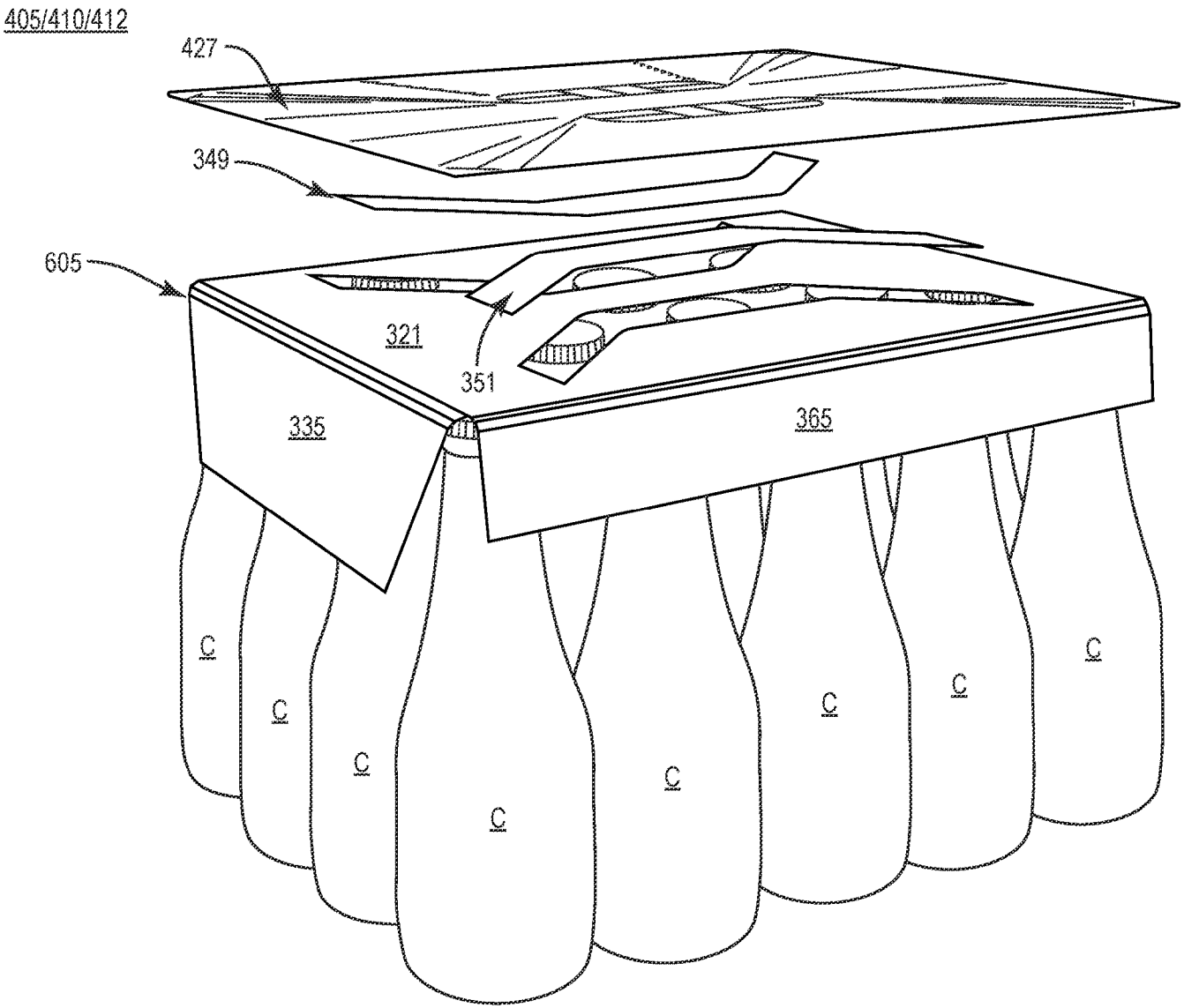
FIG. 10 is a perspective view showing an activation of handle features of the system of FIG. 8 according to the second exemplary embodiment of the disclosure.

As described herein, the carton 105 can be used to house a plurality of articles in an interior 107 thereof such as containers in the form of beverage containers C (FIG. 10) the containers can be beverage bottles, e.g., bottles formed of glass or metal, and having upper portions that include an at least partially tapered neck portion intersecting a flange that at least partially supports a cap. In other embodiments, the containers could be beverage cans or another suitable type and size of container.

Figure 5:
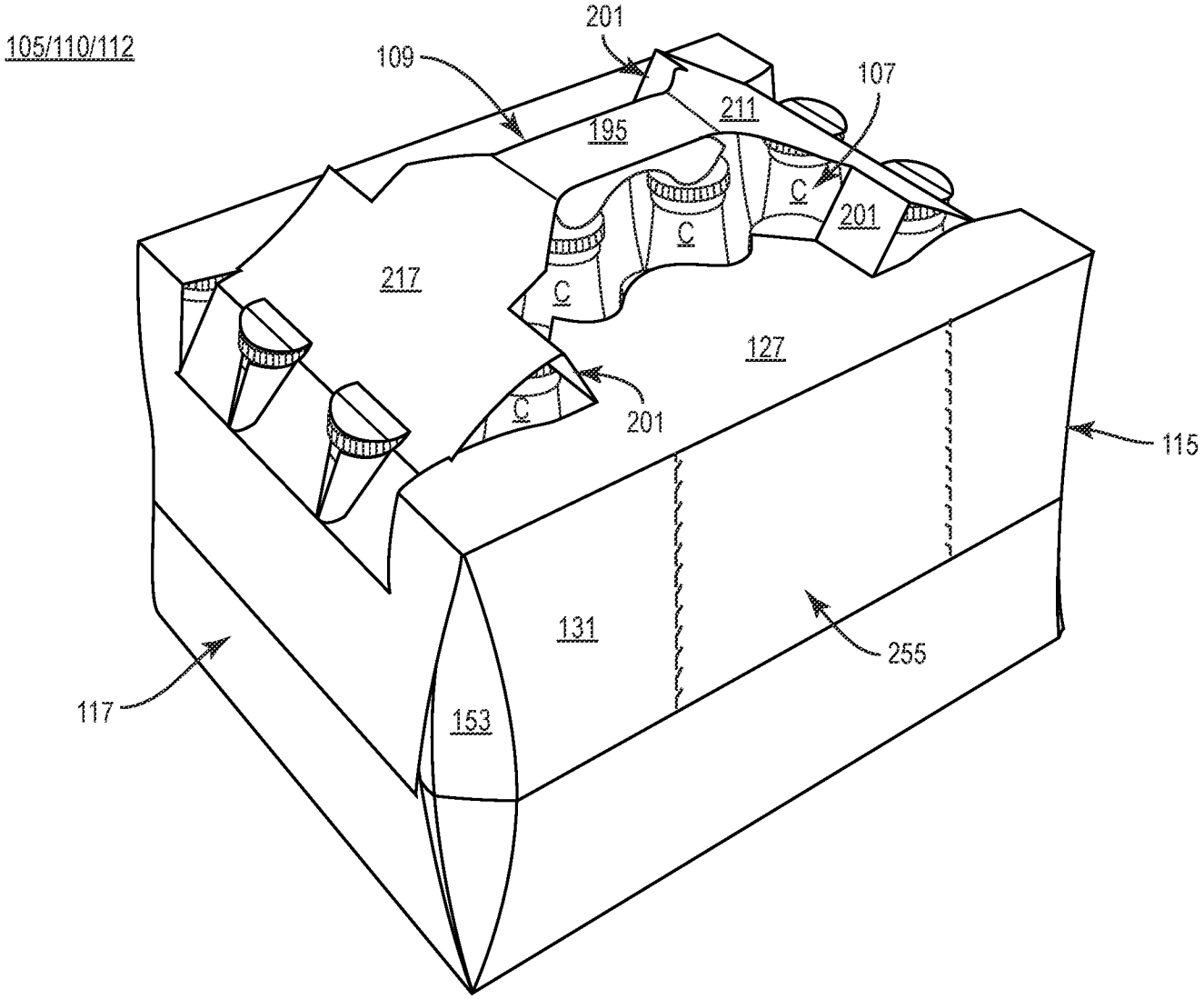
FIG. 5 is a perspective view showing an activation of handle features of the system of FIG. 4 according to the first exemplary embodiment of the disclosure.

As shown in FIG. 5, the carrier 105 is sized to contain or support eight containers C in four rows of five containers, but it will be understood that the carrier 105 can be sized and shaped to hold containers of a different or same quantity in more than one layer and/or in different row/column arrangements (e.g., 1×6, 2×2, 2×3, 2×4, 2×5, 2×6, 3×3, 3×4, 2×5, 3×6, 2×6×2, 3×5, 3×4, 4×5, 2×9, 2×6, 4×4, 4×5, 4×6, etc.).

Figure 3:
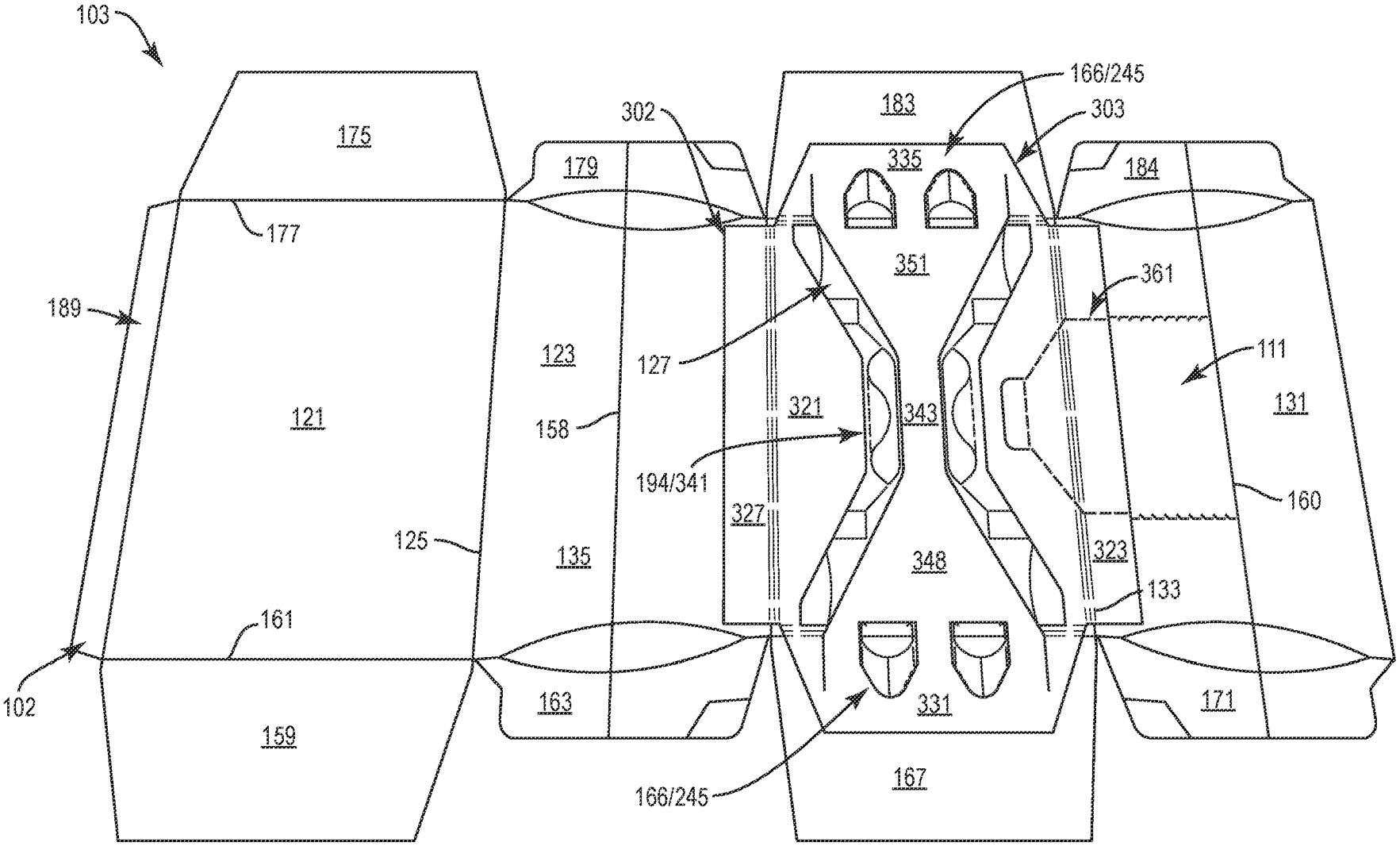
FIG. 3 is a perspective view showing a partial formation of a system including a carton formed from the blank of FIG. 1 and a reinforcement construct formed from the blank of FIG. 2 according to the first exemplary embodiment of the disclosure.
Figure 4:
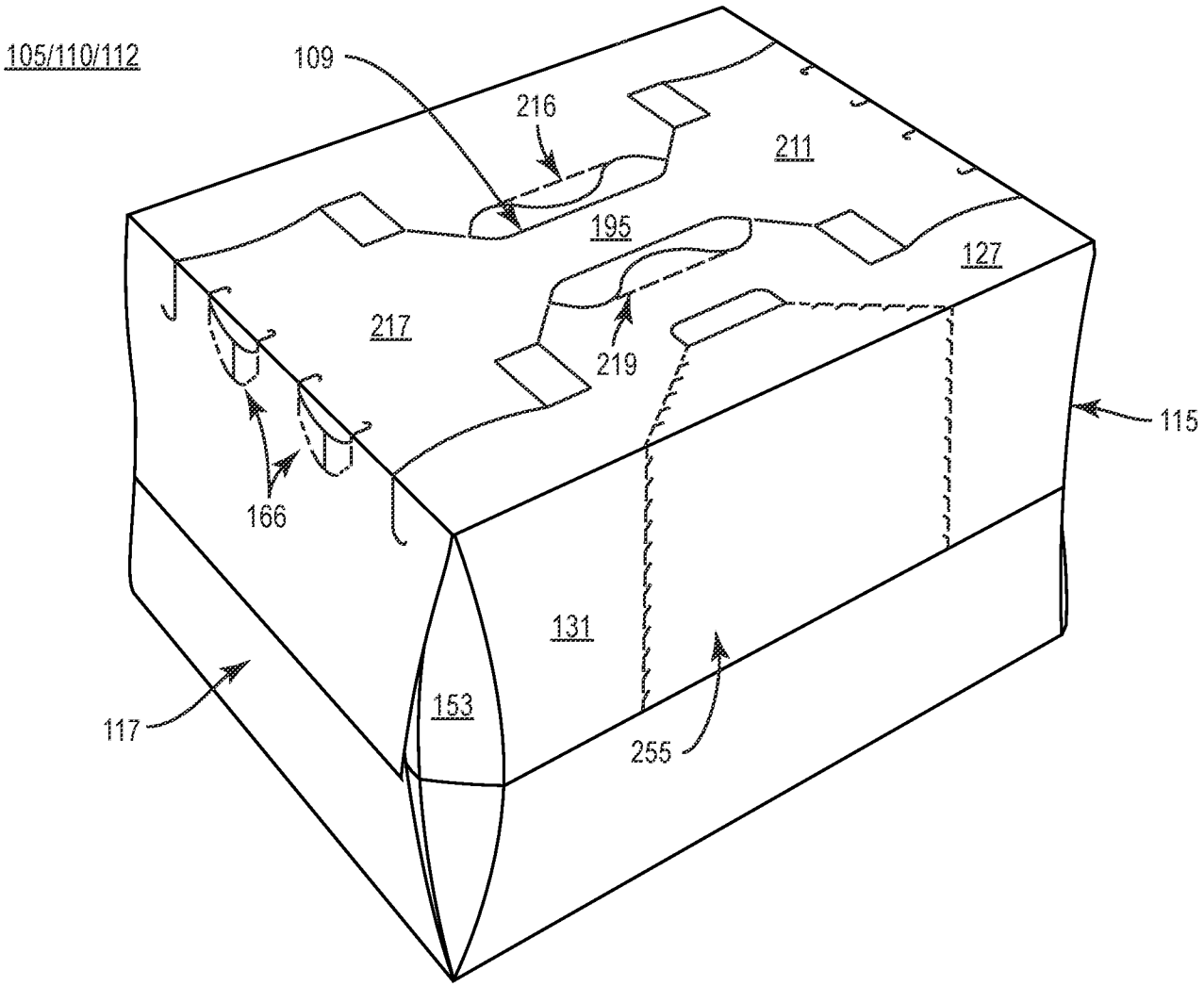
FIG. 4 is a perspective view of a system including a carton formed from the blank of FIG. 1 and a reinforcement construct formed from the blank of FIG. 2 according to the first exemplary embodiment of the disclosure.

As also described herein, the carton 105 can be provided together with a reinforcement construct 305 (FIG. 3) formed from a reinforcement blank 303 (FIG. 2) to form a system or reinforced carton 110 (FIG. 4). The reinforced carton 110 can be provided with one or more containers C as a package 112.

With continued reference to FIG. 1, the blank 103 can have a longitudinal axis L1 and a lateral axis L2, and a plurality of panels for at least partially extending around an interior 107 of the carton 105 formed from the blank 103. As described herein, the interior 107 of the carton 105 formed from the blank 103 can also be the interior 107 of the reinforced carton 110.

The plurality of panels can include a bottom panel 121, a back panel 123 foldably connected to the bottom panel 121 at a lateral fold line 125, a top panel 127 foldably connected to the back panel 123 at a lateral fold line 129, and a front panel 131 foldably connected to the top panel 127 at a lateral fold line 133.

A first back corner panel 135 can be foldably connected to the back panel 123 at a curved fold line 137, the back corner panel 135 at least partially defined between the curved fold line 137 and a curved fold line 139.

A second back corner panel 141 can be foldably connected to the back panel 123 at a curved fold line 143 such that the back corner panel 141 can be at least partially defined between the curved fold line 143 and a curved fold line 145.

Similarly, a first front corner panel 147 can be foldably connected to the front panel 131 at a curved fold line 149 such that the corner panel 147 is at least partially defined between the curved fold line 149 and a curved fold line 151.

In addition, a second front corner panel 153 can be foldably connected to the front panel 131 at a curved fold line 155 such that the corner panel 153 is at least partially defined between the curved fold line 155 and a curved fold line 157.

A plurality of end flaps can be foldably connected to a respective panel of the plurality of panels of the blank 103 and the carton 105 formed therefrom, and can include a first bottom end flap 159 foldably connected to the bottom panel 121 at a longitudinal fold line 161. A first back end flap 163 can be foldably connected to the corner panel 135 at the curved fold line 139, and can be foldably connected to the back panel 123 at an oblique fold line 165 that is interrupted by the curved fold lines 137, 139. A first top end flap 167 can be foldably connected to the top panel 127 at a longitudinal fold line 169. A first front end flap 171 can be foldably connected to the corner panel 147 at the curved fold line 151, and can be foldably connected to the front panel 131 at an oblique fold line 173 that is interrupted by the curved fold lines 149, 151.

Similarly, a second bottom end flap 175 can be foldably connected to the bottom panel 121 at a longitudinal fold line 177, a second back end flap 179 can be foldably connected to the corner panel 141 at the curved fold line 145 and can be foldably connected to the back panel 123 at an oblique fold line 181 that is interrupted by the curved fold lines 143, 145, a second top end flap 183 can be foldably connected to the top panel 127 at a longitudinal fold line 185, and a second front end flap 184 can be foldably connected to the corner panel 153 at the curved fold line 157 and can be foldably connected to the front panel 131 at an oblique fold line 187 that is interrupted by the curved fold lines 155, 157.

In this regard, the end flaps 159, 163, 167, 171 can extend along a marginal portion of the blank 103 for at least partially forming a first closed end 115 of the carton 105 formed from the blank 103, and the end flaps 175, 179, 183, 184 can extend along an opposite marginal portion of the blank 103 for at least partially forming a second closed end 117 of the carton 105 formed from the blank 103. It will be understood that the ends 115, 117 of the carton 105 can also be the ends 115, 117 of the reinforced carton 110.

As shown, the end flaps 163, 171, 179, 185 can be provided with a respective articulable feature 186 at least partially separable from a respective end flap at a respective oblique cut 188, and at least partially foldably connected to a respective end flap at a respective oblique fold line 190.

An attachment flap 189 can be foldably connected to the bottom panel 121 at a lateral line of weakening 191. In some embodiments, the attachment flap 189 can be an end flap of the plurality of end flaps, but the attachment flap 189 can be considered a panel of the plurality of panels without departing from the disclosure.

As shown, a lateral fold line 158 can bisect the back panel 123, the corner panels 135, 141, and the end flaps 163, 179, and a lateral fold line 160 can bisect the front panel 131, the corner panels 147, 153, and the end flaps 171, 184. As described further herein, the fold lines 158, 160 can facilitate erection of the carton 105 from the blank 103.

The blank 103 and carton 105 formed therefrom can also include handle features 194 for forming at least a portion of a handle 109 of the reinforced carton 110. As shown in FIG. 1A, the handle features 194 can include a handle grip portion 195 at least partially defined in the top panel 127 between a pair of lines of weakening 197, 199.

The line of weakening 197, as shown, can include a generally lateral segment 197*a*, and a pair of generally oblique segments 197*b*, 197*c* extending from respective endpoints of the segment 197*a*. Similarly, the line of weakening 199 can include a generally lateral segment 199*a* and a pair of generally oblique segments 199*b*, 199*c* extending away from respective endpoints of the segment 199*a*.

The endpoints of the lines of weakening 197, 199, as shown, can intersect a respective handle attachment feature 201 that is at least partially separable from the top panel 127 at a respective pair of spaced lateral cuts 203, and that is at least partially foldably connected to the top panel 127 at a respective pair of spaced longitudinal fold lines 205 that intersect the respective cuts 203.

A pair of lines of weakening 207, 209 can extend from respective handle attachment features 201 across the fold line 169 and at least partially into the end flap 167 to define a first handle end portion 211 of the handle features 194. The line of weakening 207 can include a generally curved segment 207*a* extending from the respective handle attachment feature 201 to the fold line 169 and a generally lateral segment 207*b* extending from the fold line 167 to a generally curved segment 207*c* having the general configuration of a relief cut.

Similarly, the line of weakening 209 can include a generally curved segment 209*a* extending from the respective handle attachment feature 201 to the fold line 169 and a generally lateral segment 209*b* extending from the fold line 167 to a generally curved segment 209*c* having the general configuration of a relief cut.

As also shown, a pair of lines of weakening 213, 215 can extend from respective handle attachment features 201 across the fold line 185 and at least partially into the end flap 183 to define a second handle end portion 217 of the handle features 194. The line of weakening 213 can include a generally curved segment 213*a* extending from the respective handle attachment feature 201 to the fold line 185 and a generally lateral segment 213*b* extending from the fold line 185 to a generally curved segment 213*c* having the general configuration of a relief cut.

Similarly, the line of weakening 215 can include a generally curved segment 215*a* extending from the respective handle attachment feature to the fold line 185 and a generally lateral segment 215*b* extending from the fold line 185 to a generally curved segment 215*c* having the general configuration of a relief cut.

In this regard, the lines of weakening 207, 209, 213, 215 are positioned extending away from the handle grip portion 195.

As shown, handle flaps 216, 219 can be provided adjacent the handle grip portion 195. The handle flap 216 can include a proximal portion 221 foldably connected to the handle grip portion 195 at the segment 197*a* of the line of weakening 197, and a distal portion 225 separably connected to the proximal portion 221 at a wave cut 227 (e.g., a cut having curved portions in the general form of a sinusoidal wave or other waveform). The distal portion 225 of the handle flap 216 can be foldably and/or separably connected to the top panel 127 at a lateral line of weakening 229.

Similarly, the handle flap 219 can include a proximal portion 231 foldably connected to the handle grip portion 195 at the segment 199*a* of the line of weakening 199, and a distal portion 235 separably connected to the proximal portion 231 at a wave cut 237, with the distal portion 235 of the handle flap 219 being foldably and/or separably connected to the top panel 127 at a lateral line of weakening 239.

In this regard, the handle features 194 of the blank 103 and carton 105 formed therefrom can be at least partially defined in the top panel 121 and the end flaps 167, 183, though a different arrangement of handle features can be provided without departing from the disclosure.

With continued reference to FIGS. 1 and 1A, the blank 103 and carton 105 formed therefrom can include container retention features 166 for at least partially receiving a portion of a respective container C of the plurality of containers C.

In the illustrated embodiment, a pair of container retention features 166 can be at least partially defined in one or both of the end flap 167 and the top panel 127, and a pair of container retention features 166 can be at least partially defined in one or both of the end flap 185 and the top panel 127.

Each container retention feature 166, as shown, can include a container retention tab 241 defined by a generally curved cut 243 that can intersect and/or extend across the respective fold line 169, 185. A pair of container retention flaps 245, 247 can be separably connected to the respective container retention tab 241 at the cut 243, and can be separably connected to each other at a respective lateral cut 249.

The respective container retention flaps 245 can be separably and/or foldably connected to the respective end flaps 167, 183 at a respective line of weakening having a generally lateral segment 251*a*, a generally oblique segment 251*b*, and a generally curved segment 251*c*. Similarly, the respective container retention flaps 247 can be separably and/or foldably connected to the respective end flaps 167, 183 at a respective line of weakening having a generally lateral segment 253*a*, a generally oblique segment 253*b*, and a generally curved segment 253*c*.

The blank 103 and carton 105 formed therefrom can further include dispenser features 111 for forming a dispenser 113. The dispenser features 111 can include a dispenser panel 255 having a front portion 257 at least partially defined by a pair of spaced longitudinal tear lines 259, 261 extending from the fold line 133 to the longitudinal fold line 160. The dispenser panel 255 can also have a top portion 263 at least partially defined by a pair of oblique tear lines 265, 267 that extend from the fold line 133 to a lateral fold line 275.

An access tab 271, as shown, can be at least partially defined by a generally rounded bracket-shaped cut 273 that intersects the fold line 275 such that the access tab 271 is foldably connected to the dispenser panel 255 at the fold line 275.

Figure 2:
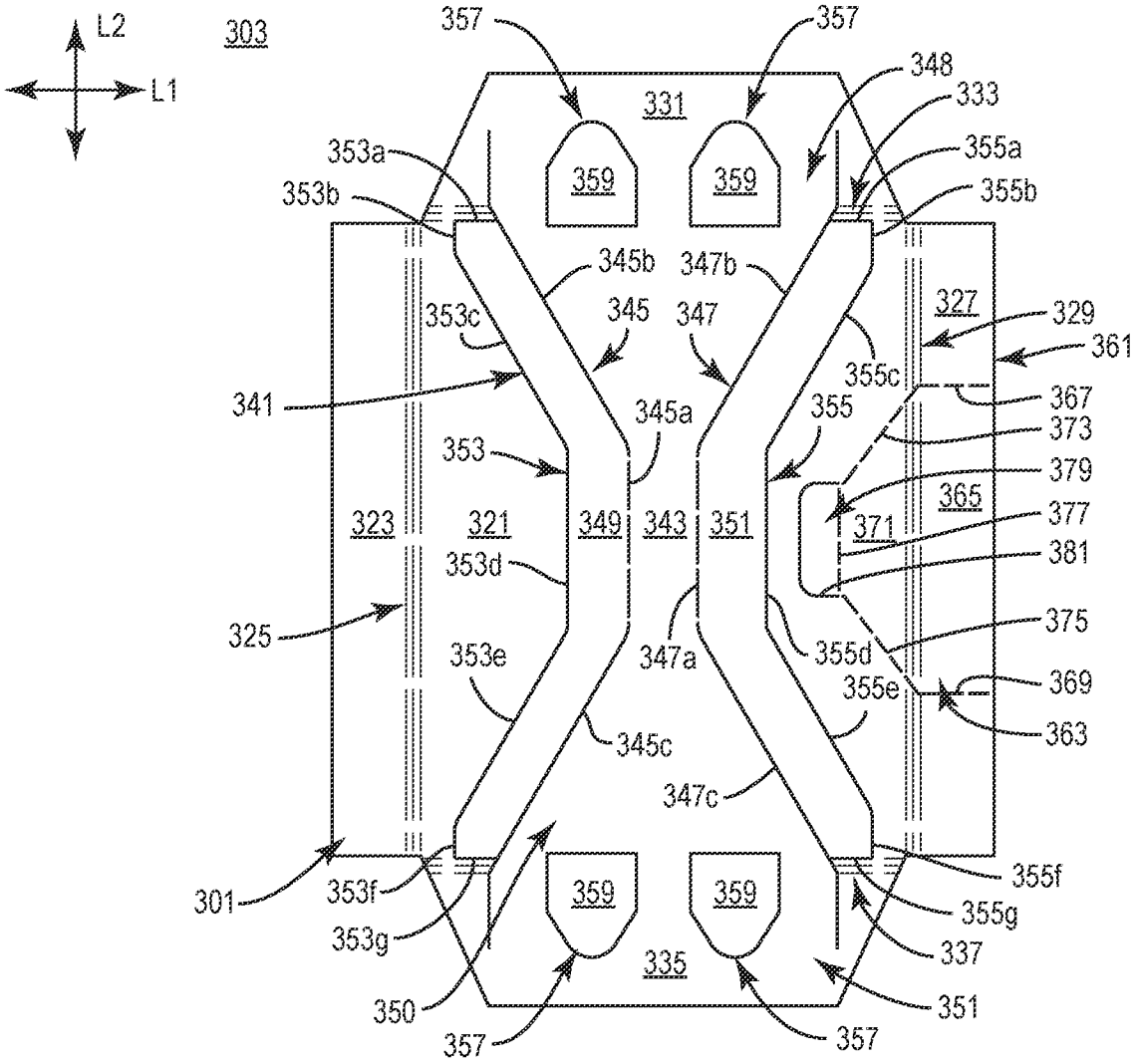
FIG. 2 is a plan view of an exterior surface of a reinforcement blank for forming a reinforcement construct according to the first exemplary embodiment of the disclosure.

Turning to FIG. 2, the exterior surface 301 of the reinforcement blank 303 is illustrated. As described herein, the reinforcement blank 303 can be provided in combination with the carton blank 103 such that the reinforced carton 110 can be formed therefrom.

As shown, the reinforcement blank 303 can have the longitudinal axis L1 and the lateral axis L1, and can include a reinforcement panel or central panel 321. A plurality of end flaps can be at least partially foldably connected to the central panel 321, and can include a back end flap 323 at least partially foldably connected to the central panel 321 at a plurality of lateral lines of weakening 325, a front end flap 327 at least partially foldably connected to the central panel 321 at plurality of lateral lines of weakening 329, a first end flap 331 foldably connected to the central panel 321 at a plurality of longitudinal lines of weakening 333, and a second end flap 335 foldably connected to the central panel 321 at a plurality of longitudinal lines of weakening 337.

As shown, the respective pluralities of lines of weakening 325, 329, 333, 337 can include two or more (e.g., three, as illustrated) spaced and parallel lines of weakening that can have one or more discontinuities therealong. It will be understood that the reinforcement blank 303 and reinforcement construct 305 formed therefrom can have a different arrangement of panels, end flaps, and/or lines of weakening without departing from the disclosure.

The blank 303 and construct 305 formed therefrom can include handle features 341 that can include a handle grip portion 343 at least partially defined in the central panel 321 between a pair of lines of weakening 345, 347. The line of weakening 345, as shown, can include a generally lateral segment 345*a* and a pair of generally oblique segments 345*b*, 345*c* extending away from the segment 345*a* and at least partially into the respective end flaps 331, 335.

Similarly, the line of weakening 347 can include a generally lateral segment 347*a* and a pair of generally oblique segments 347*b*, 347*c* extending away from the segment 347*a* and at least partially into the respective end flaps 331, 335.

In this regard, the handle grip portion 343 can be at least partially defined in the central panel 321 between respective portions of the lines of weakening 345, 347, a first handle end portion 348 can be at least partially defined in the end flap 331 and the central panel 321 between respective portions of the lines of weakening 345, 347, and a second handle end portion 350 can be at least partially defined in the end flap 335 and the central panel 231 between respective portions of the lines of weakening 345, 347.

The handle features 341 of the blank 303 and construct 305 formed therefrom can also include a pair of handle reinforcement flaps 349, 351 at least partially defined in the central panel 321.

As shown, the handle reinforcement flap 349 (broadly, "first handle reinforcement flap" or "second handle reinforcement flap") can be at least partially foldably connected to the handle grip portion 343 at the segment 345*a* of the line of weakening 345 and can be at least partially separable therefrom at the respective segments 345*b*, 345*c*. The handle reinforcement flap 349 (broadly, "first handle reinforcement flap" or "second handle reinforcement flap") can be further defined in and separable from the central panel 321 at a cut 353 having a longitudinal segment 353*a* extending from the segment 345*b* of the line of weakening 345, a lateral segment 353*b* extending from the segment 353*a*, an oblique segment 353*c* extending from the segment 353*b*, a lateral segment 353*d* extending from the segment 353*c*, an oblique segment 353*e* extending from the segment 353*d*, a lateral segment 353*f* extending from the segment 353*e*, and a longitudinal segment 353*g* extending from the lateral segment 353*f* to the segment 345*c* of the line of weakening 345.

Similarly, the handle reinforcement flap 351 can be at least partially foldably connected to the handle grip portion 343 at the segment 347*a* of the line of weakening 347 and can be at least partially separable therefrom at the respective segments 347*b*, 347*c*. The handle reinforcement flap can be further defined by and separable from the central panel 321 at a cut 355 having a longitudinal segment 355*a* extending from the segment 347*b* of the line of weakening 347, a lateral segment 355*b* extending from the segment 355*a*, an oblique segment 355*c* extending from the segment 355*b*, a lateral segment 355*d* extending from the segment 355*c*, an oblique segment 355*e* extending from the segment 355*d*, a lateral segment 355*f* extending from the segment 355*e*, and a longitudinal segment 355*g* extending from the lateral segment 355*f* to the segment 347*c* of the line of weakening 347.

The blank 303 and construct 305 formed therefrom can further include container retention features 357 that include respective pairs of container retention openings 359 at least partially defined in the respective end flaps 331, 335. In some embodiments, the container retention openings 359 can extend at least partially into the central panel 321.

Further, the blank 303 and construct 305 formed therefrom can include dispenser features 361 that can include a dispenser panel 363 having a front portion 365 at least partially defined by a pair of spaced longitudinal tear lines 367, 369 extending from a free edge of the end flap 327 to the plurality of fold lines 329 so as to interrupt the plurality of fold lines 329. The dispenser panel 363 can also have a top portion 371 at least partially defined by a pair of oblique tear lines 373, 375 that extend from the fold lines 329 to a lateral fold line 377.

An access tab 379, as shown, can be at least partially defined by a generally rounded bracket-shaped cut 381 that intersects the fold line 377 such that the access tab 379 is foldably connected to the dispenser panel 363 at the fold line 377.

As described herein, the handle features 341 of the blank 303 and construct 305 formed therefrom are for being at least partially aligned with the handle features 194 of the blank 103 and carton 105 formed therefrom when the reinforced carton 110 is formed, the container retention features 357 of the blank 303 and construct 305 formed therefrom are for being at least partially aligned with the container retention features 166 of the blank 103 and carton 105 formed therefrom when the reinforced carton 110 is formed, and the dispenser features 361 of the blank 303 and construct 305 formed therefrom are for being at least partially aligned with the dispenser features 111 of the blank 103 and carton 105 formed therefrom when the reinforced carton 110 is formed.

With additional reference to FIGS. 3 and 4, according to one embodiment, the construct blank 103 can be positioned with the exterior surface 101 thereof on a supporting surface and with an interior surface 102 thereof facing upwardly. In such arrangement, the reinforcement blank 303 can be positioned with the exterior surface 301 thereof in at least partial face-to-face contact with the interior surface 102 of the construct blank 103, and with an interior surface 302 of the reinforcement blank 303 facing upwardly.

Prior to such positioning of the construct blank 303 relative to the carton blank 103, the handle reinforcement flaps 349, 351 can be at least partially separated from the central panel 321 of the construct blank 303 at respective portions of the respective lines of weakening 353, 355 355, 357 and to fold at respective segments 345*a*, 347*a* of the respective lines of weakening 345, 347 such that a respective handle reinforcement flap 349, 351 can be positioned in at least partial face-to-face contact with respective portions of the handle portion 343 and handle end portions 348, 350 such that the handle reinforcement flaps 349, 351 are positioned between the central panel 321 of the construct blank 303 and the top panel 127 of the carton blank 103.

In one embodiment, the handle reinforcement flap 349 can be positioned in at least partial face-to-face contact with the handle grip portion 343 and handle end portions 348, 350 and the handle reinforcement flap 351 can be positioned in at least partial face-to-face contact with the handle reinforcement flap 349 so as to also be in at least partial face-to-face contact with the handle grip portion 195 and the handle end portions 211, 217 of the carton blank 103/carton 105. In another embodiment, the handle reinforcement flap 351 can be positioned in at least partial face-to-face contact with the handle grip portion 343 and handle end portions 348, 350 and the handle reinforcement flap 349 can be positioned in at least partial face-to-face contact with the handle reinforcement flap 351 so as to also be in at least partial face-to-face contact with the handle grip portion 195 and the handle end portions 211, 217 of the carton blank 103/carton 105.

The central panel 321 of the reinforcement blank 303 can be generally aligned with the top panel 127 of the construct blank 103, such that the end flap 331 of the reinforcement blank 303 is generally aligned with the end flap 167 of the construct blank 103, such that the end flap 335 of the reinforcement blank 303 is generally aligned with the end flap 183 of the construct blank 103, such that the front end flap 327 of the reinforcement blank 303 is at least partially aligned with the front panel 131 of the construct blank 103, and such that the back end flap 323 of the reinforcement blank 303 is at least partially aligned with the back panel 123 of the construct blank 103.

In such an arrangement, the back panel 123 can be folded at the fold line 158 such a portion of the back panel 123 is folded into at least partial face-to-face contact with a portion of itself, such that the bottom panel 121 is carried into at least partial face-to-face contact with a respective portion of the central panel 321 of the construct blank 303, and such that the attachment flap 189 is carried into at least partial face-to-face contact with a portion of the front panel 131.

Thereafter, a portion of the front panel 131 can be folded at the fold line 160 into at least partial face-to-face contact with another portion of the front panel 131 and the attachment flap 189.

Such an arrangement can be considered a partially folded arrangement of the blank 103 and/or a collapsed configuration of the carton 105/reinforced carton 110.

Thereafter, the top panel 131 and bottom panel 121 can be positioned in generally spaced and parallel relation, with the front panel 131 and the back panel 123 extending from the top panel 131 to the bottom panel 121 in generally spaced and parallel relation. The attachment flap 189 can be positioned in at least partial face-to-face contact with the front panel 131. Such an arrangement can be accomplished by folding the plurality of panels of the blank 103/carton 105 at one or more of the fold lines 125, 129, 133, 158, 160, 191.

Such an arrangement can be considered an open sleeve configuration of the carton 105/reinforced carton 110, in which the interior 107 of the carton 105/reinforced carton 110 is accessible, for example, for receiving one or more containers C therein. In some embodiments, one or more containers C can be positioned in the interior 107 of the carton 105/reinforced carton 110 through one or both open ends of the carton 105/reinforced carton 110, for example, via one or more actuated loading arms/pushers and/or conveyor mechanisms.

The corner flaps 135, 147 can be folded at the respective fold lines 137, 149, the end flaps 163, 171 can be folded at the respective fold lines 139, 165, 151, and 173, the end flap 159 can be folded upwardly at the fold line 161, and the end flap 167 can be folded downwardly at the fold line 169 into at least partial face-to-face contact with respective portions of the end flaps 159, 163, 171 to form the first closed end 115 of the carton 105/reinforced carton 110.

Similarly, the corner flaps 141, 153 can be folded at the respective fold lines 143, 155, the end flaps 179, 184 can be folded at the respective fold lines 145, 181, 157, 187, the end flap 175 can be folded upwardly at the fold line 177, and the end flap 183 can be folded downwardly at the fold line 185 into at least partial face-to-face contact with respective portions of the end flaps 175, 179, 185 to form the second closed end 117 of the carton 105/reinforced carton 110.

It will be understood that the above-described arrangement of end flaps can be at least partially facilitated by the movement of one or more respective articulable feature 186 relative to the remainder of a respective end flap a respective oblique cut 188 and/or a respective oblique fold line 190.

In the aforementioned closed-ended arrangement of the carton 105/reinforced carton 110, the corner panel 135 extends obliquely between the back panel 123 and the first closed end 115, the corner panel 147 extends between the front panel 131 and the closed end 115, the corner panel 141 extends between the back panel 123 and the closed end 117, and the corner panel 153 extends between the front panel 131 and the closed end 117.

In the course of forming the above-identified arrangement of the carton 105/reinforced carton 110, folding of the front panel 131 of the blank 103/carton 105 at the fold line 133 can cause the end flap 327 of the blank 303/construct 305 to fold downwardly at the plurality of fold lines 329, the folding of the back panel 123 of the blank 103/carton 105 at the fold line 129 can cause the end flap 323 of the blank 303/construct 305 to fold downwardly at the plurality of fold lines 325, the folding of the end flap 167 of the blank 103/carton 105 at the fold line 169 can cause the end flap 331 to fold at least partially downwardly at the plurality of fold lines 333, and the folding of the end flap 183 of the blank 103/carton 105 at the fold line 185 can cause the end flap 335 to fold at least partially downwardly at the plurality of fold lines 337 to form the construct 305 from the blank 303.

It will be understood that the above-described arrangement of the carton 105 and construct 305, including associated panels, end flaps, features, etc., can be at least partially maintained with one or more applications of an adhesive such as glue.

The container retention features of the carton 105 and construct 305 can engage/receive respective portions of the containers C upon formation of the reinforced carton 110. In particular, containers C adjacent the respective ends 115, 117 of the carton 105/reinforced carton 110 can be at least partially received through the respective container retention openings 359 in the construct 305 and one or more portions of the container retention features 166 of the carton 105 aligned thereabove. In particular, upper portions of the respective containers C, e.g., proximate a respective cap and/or neck thereof, can press against respective container retention tabs 241 and container retention flaps 245, 247 can be at least partially separated from the top panel 121, the end flaps 166, 183, and/or each other at respective lines of weakening 249, 251*a*, 251*b*, 251*c*, 253*a*, 253*b*, 253*c*.

In this regard, respective container retention tabs 241 and respective container retention flaps 245, 247 can move at least partially outwardly relative to the interior 107 of the reinforced carton 110 upon engagement of respective portions of respective containers C thereagainst. In some embodiments, the container retention tabs 241 and container retention flaps 245, 247 can provide a barrier or buffer between respective portions of respective containers C and objects that might impact the containers C, can minimize the profile of protruding portions of containers C that might catch objects around the reinforced carton 110, etc.

With additional reference to FIG. 5, in order to engage the handle 109 of the reinforced carton 110, for example, to lift, carry, or otherwise move the reinforced carton 110, a user can engage the handle flaps 216, 219 to access the interior 107 of the reinforced carton 110. For example, in one embodiment, a user can engage one or more of his or her fingers against one of the handle flaps 216, 219, e.g., so as to cause a respective proximal portion 221, 231 thereof to at least partially separate from the respective distal portion thereof 225, 235 at the respective cut 227, 237, and the user can engage the other of the handle flaps 216, 219 with one or more of his or her fingers with the same effect.

In this regard, the user's fingers can be inserted through respective openings formed by the at least partial separation of the respective handle flaps 216, 219 of the carton 105 as described above. For example, the aforementioned engagement of the handle flaps 216, 219 by a user can cause the respective proximal portions 221, 231 to fold at least partially downwardly at the respective fold lines 197*a*, 199*a* and can cause the respective distal portions 225, 235 to fold at least partially downwardly at the respective fold lines 229, 239.

The user can thus curl his or her fingers about a multi-ply, e.g., four ply, structure formed by the arrangement of, in order from top to bottom: the handle grip portion 195 of the carton 105; the overlapped handle reinforcement flaps 349, 351 (optionally, in either order); and the handle grip portion 343 of the construct 305.

In some embodiments, the proximal portions 221, 231 of the respective handle flaps 216, 219 of the carton 205 can be at least partially folded into overlapping arrangement with a portion of one or more of the handle grip portion 195, handle grip portion 343, and reinforcement flaps 349, 351.

Accordingly, the handle 109 of the reinforced carton 110 is provided with a reinforced gripping structure about which the user can wrap a portion of his or her hand and/or fingers, e.g., for comfort (so as to avoid pinching), to provide multiple layers of material to avoid the incidence and propagation of tears along the handle 109 and/or other portions of the reinforced carton 110, etc. Such arrangement can obviate the use of other handle reinforcement structures.

Upon further lifting of the handle 109, the handle end portion 211 of the carton 105 and the handle end portion 348 of the construct 305 aligned therebelow can at least partially separate from the respective top panel 121 and end flap 167 and the top panel 121 and the central panel 321 and end flap 331 at the respective portions of the respective lines of weakening 207, 209, 345, 347.

Similarly, the handle end portion 217 of the carton 105 and the handle end portion 350 of the construct 305 aligned therebelow can at least partially separate from the respective top panel 121 and end flap 183 and the top panel 121 and the central panel 321 and end flap 345 at the respective portions of the respective lines of weakening 213, 215, 345, 347.

In this regard, separation of the respective handle end portions 211, 217, 348, 350 from the remainder of the reinforced carton 110 can provide a relatively even and widespread distribution of stresses due to the weight of the reinforced carton 110 and containers C held therein along portions of the reinforced carton 110, for example, to reduce pressure on the user's hand(s), to inhibit tearing of one or more portions of the reinforced carton 110, etc.

In some embodiments, the respective handle attachment features 201 can at least partially separate from the top panel 127 of the carton 105 at the respective cuts 203 to provide an intermediate point of attachment of the handle 109 to the remainder of the reinforced carton 110 along portions of the handle 109 that have been separated from the remainder of the reinforced carton 110. In some embodiments, the handle attachment features 201 can facilitate the maintenance of an aligned relationship between the handle grip portions 195 and handle end portions 211, 217 of the carton 105 and the handle grip portion 343 and handle end portions 348, 350 of the construct 305.

As also shown, the handle 109 can be arranged so as to at least partially restrict access to the containers C in the interior 107 of the reinforced carton 110 without deliberate manipulation by a user.

When it is desired to access one or more containers C in the interior 107 of the reinforced carton 110, a user can engage, e.g., press, on the access tab 271 of the carton 105 and the access tab 379 of the construct 305 therebelow to cause the access tab 271 to at least partially separate from the top panel 127 at the cut 273 and to cause the access tab 379 to at least partially separate from the central panel 321 at the cut 381. The aligned access tabs 271, 379 can be folded inwardly toward the interior 107 of the reinforced carton 110 at the aligned fold lines 275, 377 to allow the user to contact an interior surface of the dispenser panel 361.

The dispenser panel 361 can at least partially separated from the central panel 321 and end flap 327 of the construct 305 at the respective lines of weakening 367, 369, 373, 375, and the dispenser panel 255 can at least partially separate from the top panel 127 and the front panel 131 of the carton 105 at the respective lines of weakening 259, 261, 265, 267, to provide a dispenser opening through which the interior 107 of the reinforced carton 110 is accessible and through which one or more containers C can be withdrawn.

It will be understood that the dispenser 113 can be accessed/activated differently without departing from the disclosure.

It will be understood that one or more of the panels, end flaps, and/or features of one or both of the carton 105 and construct 305 (and reinforced carton 110 formed therefrom) can be differently configured and/or arranged without departing from the disclosure.

Figure 6:
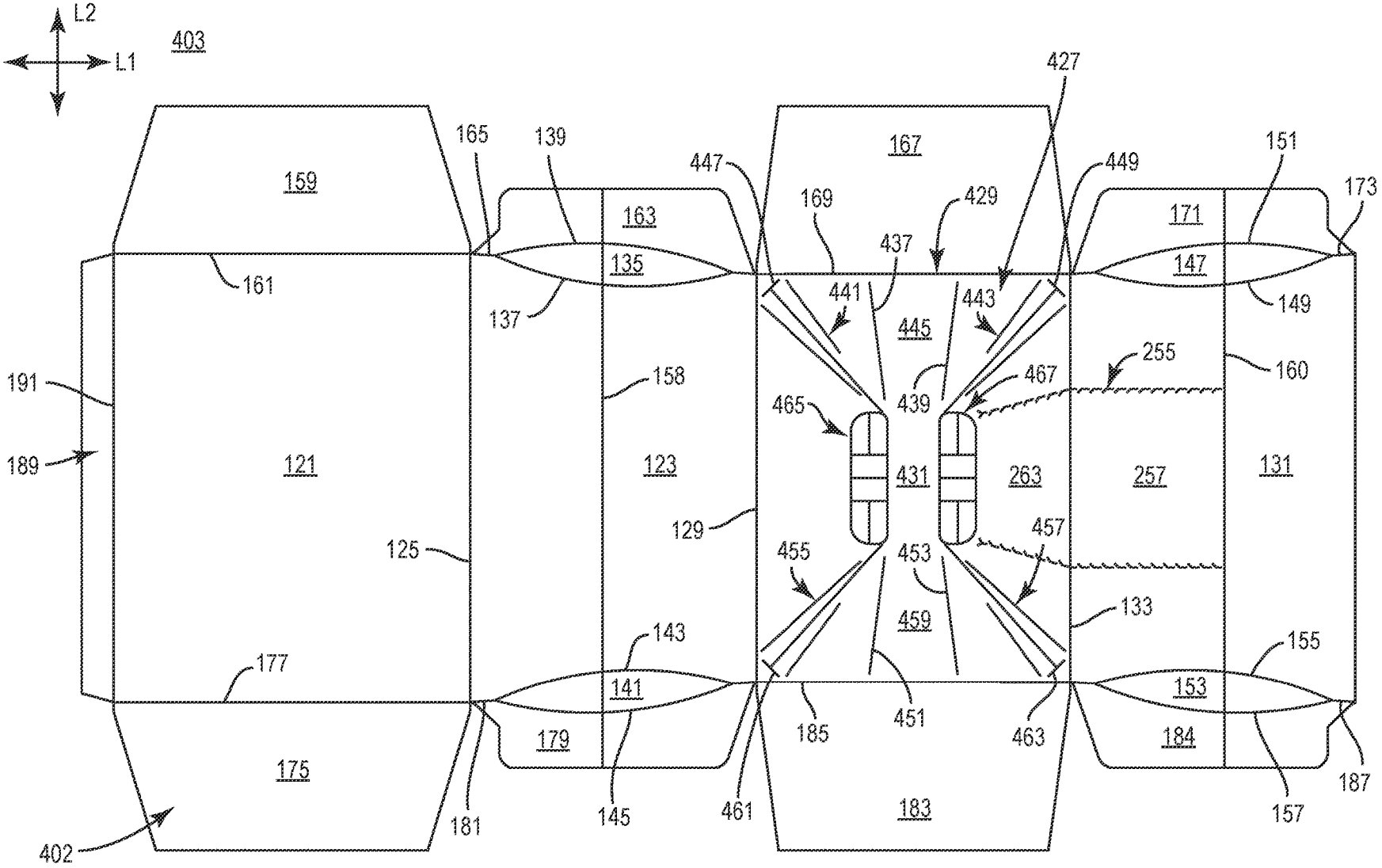
FIG. 6 is a plan view of an exterior surface of a carton blank for forming a carton according to a second exemplary embodiment of the disclosure.
Figure 6A:
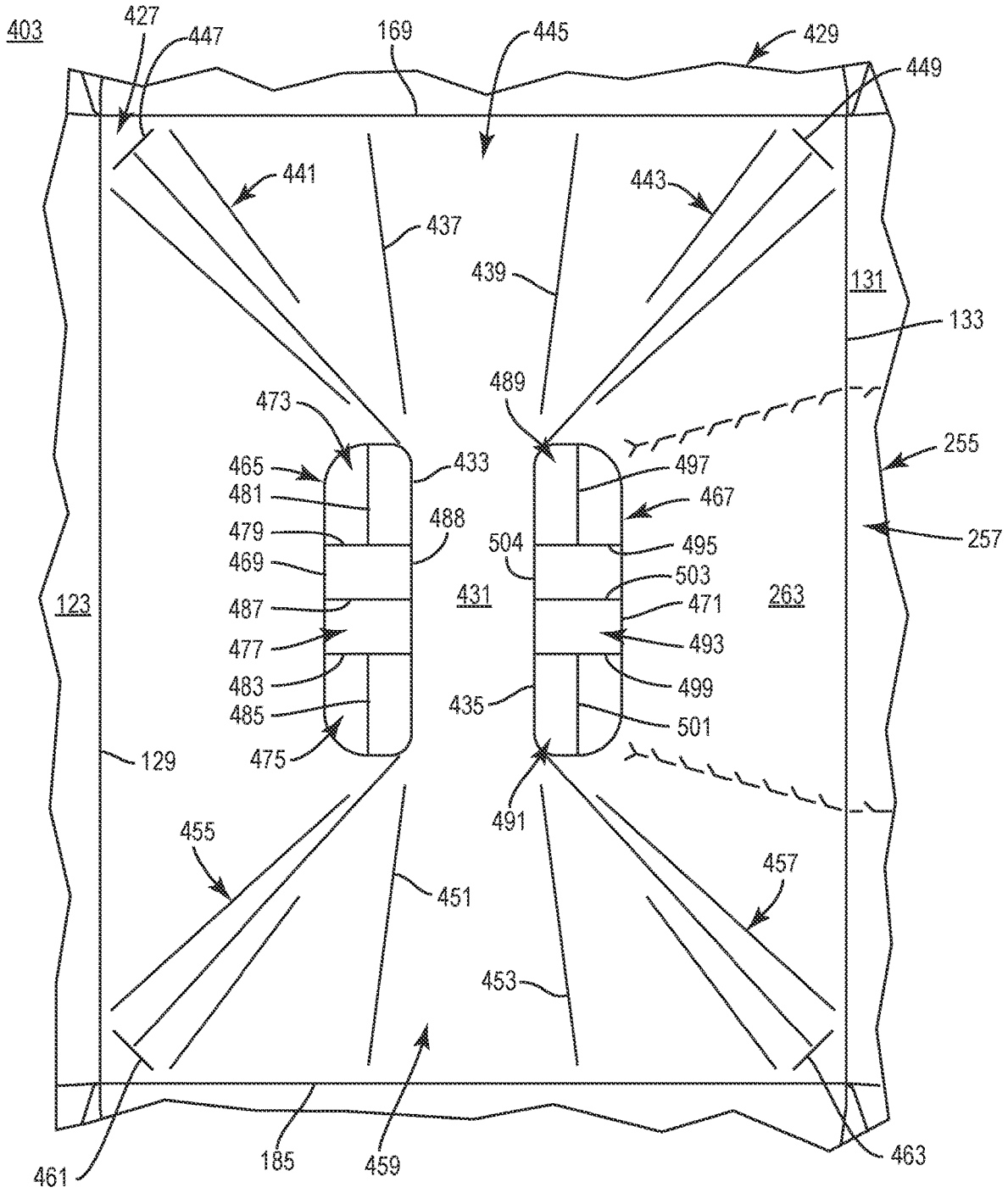
FIG. 6A is an enlarged view of a portion of the blank of FIG. 6.

With additional reference to FIG. 6, a plan view of the exterior surface 401 of a first blank or carton blank, generally indicated at 403, that can be obtained to form a carton 405 (FIG. 8) is illustrated according to a second exemplary embodiment of the disclosure. FIG. 6A is an enlarged view of a portion of the blank 403.

The carton 405 formed from the blank 403 can be provided together with a reinforcement construct 605 (FIG. 10) formed from a second blank or reinforcement blank 603

Figure 7:
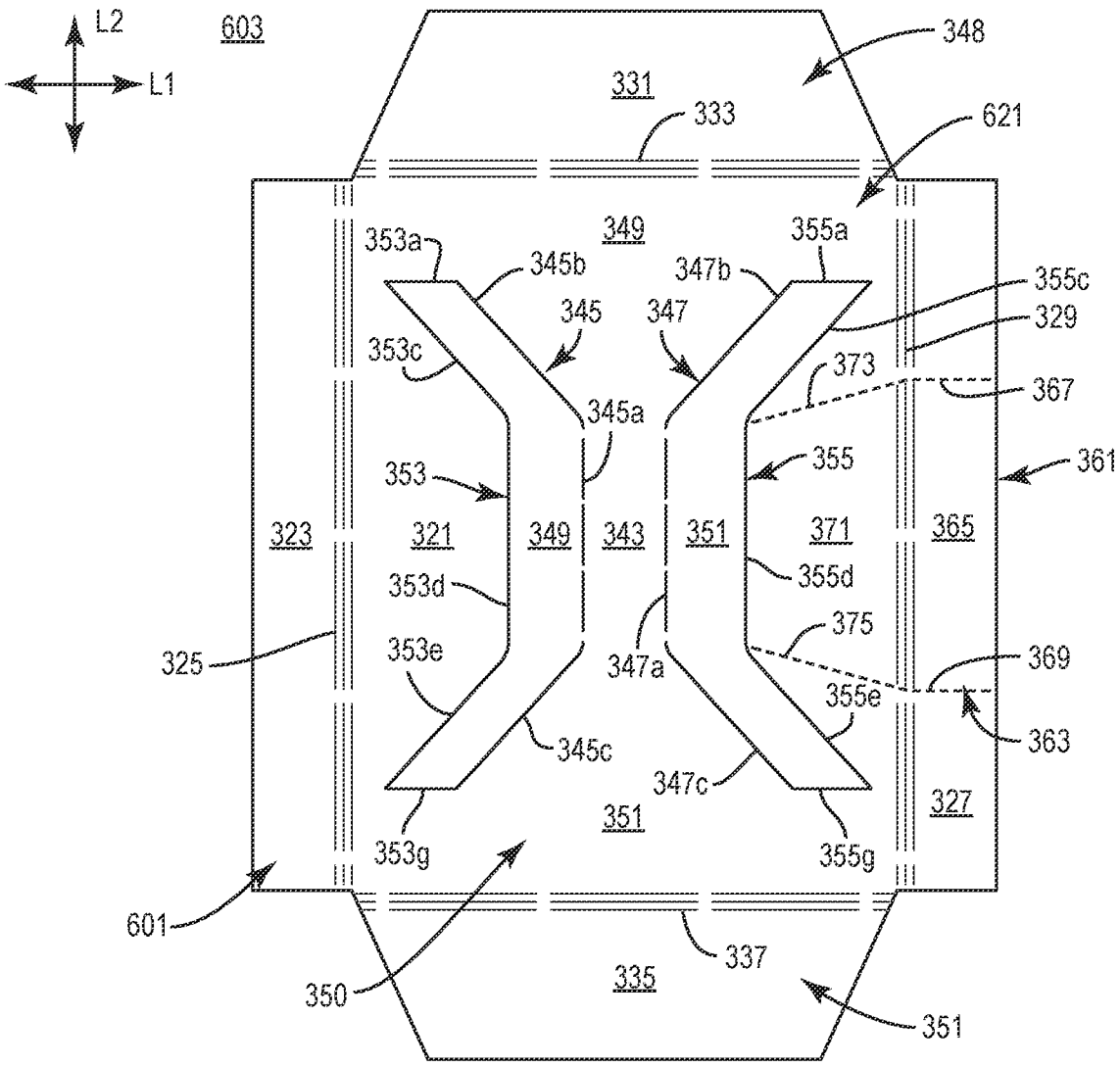
FIG. 7 is a plan view of an exterior surface of a reinforcement blank for forming a reinforcement construct according to the second exemplary embodiment of the disclosure.
Figure 8:
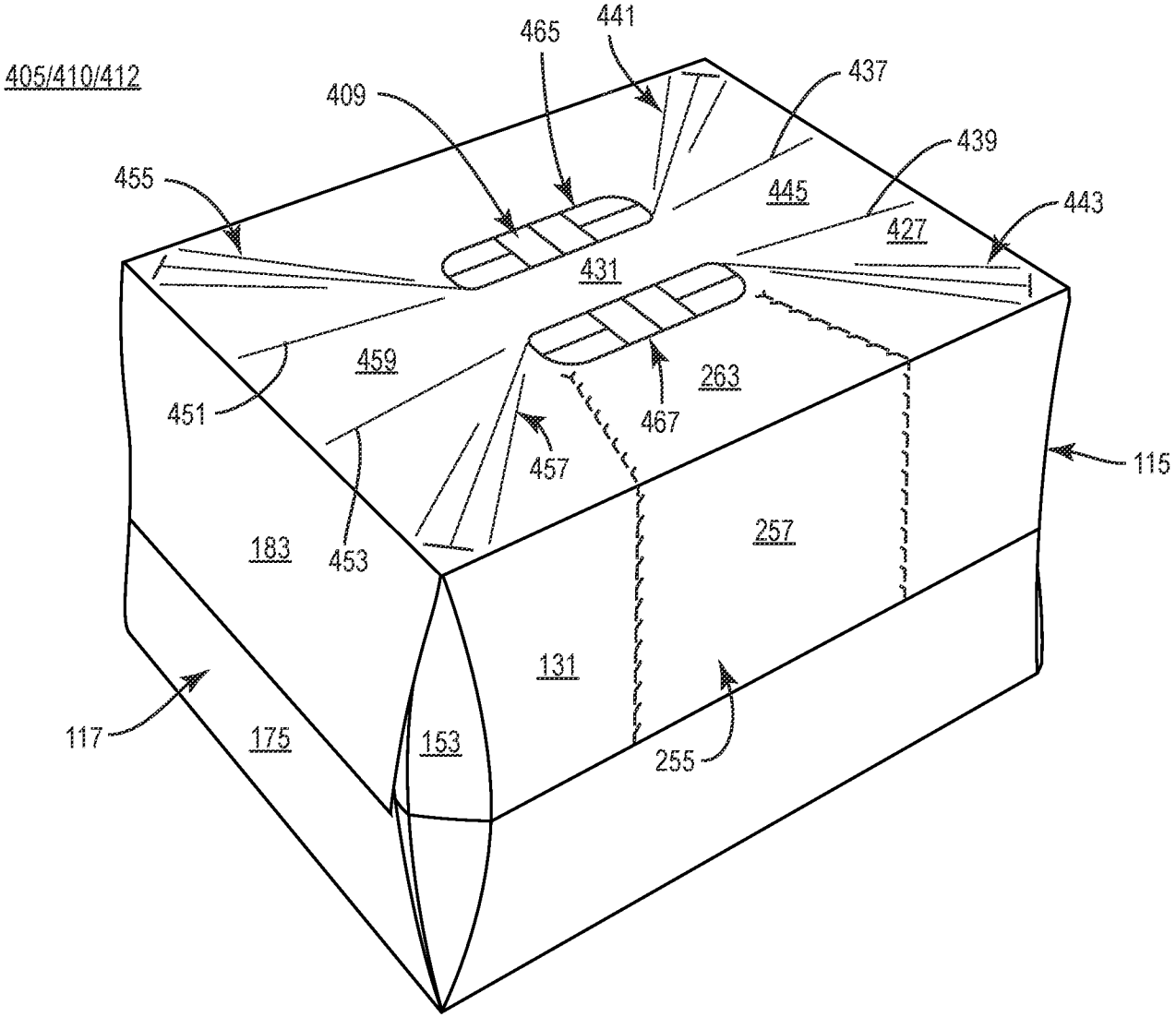
FIG. 8 is a perspective view of a system including a carton formed from the blank of FIG. 6 and a reinforcement construct formed from the blank of FIG. 7 according to the second exemplary embodiment of the disclosure.

(FIG. 7) to form a system or reinforced carton 410 (FIG. 8). The reinforced carton 410 can be provided with one or more containers C as a package 412.

The blank 403 and the carton 405 formed therefrom, the blank 603 and the construct 605 formed therefrom, and the reinforced carton 410 formed therefrom can have one or more features that are the same or similar to the blanks 103, 303, carton 105, construct 305, and reinforced carton 110 described above, and like or similar features are designated with like or similar reference numerals.

As shown in FIG. 6, the blank 403 can have the longitudinal axis L1, the lateral axis L2, the bottom panel 121, the back panel 123, the front panel 131, the corner panels 135, 147, 141, 153, the end flaps 159, 163, 167, 171, 175, 179, 183, 184, the dispenser panel 255, the attachment flap 189, and associated features.

In the illustrated embodiment, the end flaps 159, 163, 167, 171, 175, 179 could be provided without the articulable features 186, though it will be understood that one or more articulable features could be provided without departing from the disclosure. The blank 403 and carton 405 formed therefrom can also be provided without container retention features 166, though container retention features could be provided without departing from the disclosure.

The blank 403 includes a top panel 427 foldably connected to the back panel 123 at the fold line 129, and foldably connected to the front panel 131 at the fold line 133.

With additional reference to FIG. 6A, the blank 403 and carton 405 formed therefrom can also include handle features 429 for forming at least a portion of a handle 409 of the reinforced carton 410. The handle features 429 can include a handle grip portion 431 at least partially defined in the top panel 427 between a pair of lines of weakening 433, 435.

A pair of oblique central lines of weakening 437, 439 and a pair of pluralities of outer oblique lines of weakening 441, 443 can be provided in spaced relation extending away from the handle grip portion 431 to define a first handle end portion 445 of the handle features 429. Oblique lines of weakening 447, 449 can be provided in the top panel 427 proximate the respective pluralities of lines of weakening 441, 443.

Similarly, a pair of oblique central lines of weakening 451, 453 and a pair of pluralities of outer oblique lines of weakening 455, 457 can be provided in spaced relation extending away from the handle grip portion 431 to define a second handle end portion 459 of the handle features 429. Oblique lines of weakening 461, 463 can be provided in the top panel 427 proximate the respective pluralities of lines of weakening 455, 457.

As shown, handle flaps 465, 467 can be provided adjacent the handle grip portion 431. The handle flaps 465, 467 can be at least partially foldably connected to the handle grip portion 431 at the respective lines of weakening 433, 435. Each handle flap 465, 467 can be at least partially separable from the top panel 427 at a respective generally rounded bracket-shaped cut 469, 471 that intersects respective endpoints of the respective lines of weakening 433, 435.

The handle flap 465, as shown, can include a pair of laterally outer portions 473, 475 and a central portion 477 positioned between the outer portions 473, 475. The laterally outer portion 473 can be at least partially defined by a longitudinal line of weakening 479 intersecting a lateral line of weakening 481, and the laterally outer portion 475 can be at least partially defined by a longitudinal line of weakening 483 intersecting a lateral line of weakening 485. The central portion 477 can be at least partially defined between the lines of weakening 479, 483, and can be at least partially bisected by a longitudinal cut 487 that intersects the cut 469 and a lateral cut 488 that interrupts the line of weakening 433.

Similarly, the handle flap 467 can include a pair of laterally outer portions 489, 491 and a central portion 493 positioned between the outer portions 489, 491. The laterally outer portion 489 can be at least partially defined by a longitudinal line of weakening 495 intersecting a lateral line of weakening 497, and the laterally outer portion 491 can be at least partially defined by a longitudinal line of weakening 499 intersecting a lateral line of weakening 501. The central portion 493 can be at least partially defined between the lines of weakening 495, 499, and can be at least partially bisected by a longitudinal cut 503 that intersects the cut 471 and a lateral cut 504 that interrupts the line of weakening 435.

Turning to FIG. 7, the exterior surface 601 of the reinforcement blank 603 for forming the reinforcement construct 605 is illustrated.

As shown, the reinforcement blank 603 can have a configuration similar to that of the reinforcement blank 303 described above, e.g., having the longitudinal axis L1 and the lateral axis L2, the reinforcement panel or central panel 321, the back end flap 323, the front end flap 327, the first end flap 331, the second end flap 335, handle features 621 that include the lines of weakening 345, 347, 353, 355, the handle grip portion 343, the handle end portions 349, 351, the dispenser panel 361, and associated features.

However, in the illustrated embodiment, the lines of weakening 345, 347 can be arranged so as not to extend into the respective end flaps 331, 335 and the container retention features 357 can be omitted, though one or more of these features can be provided with the blank 603 and construct 605 formed therefrom without departing from the disclosure.

Figure 9:
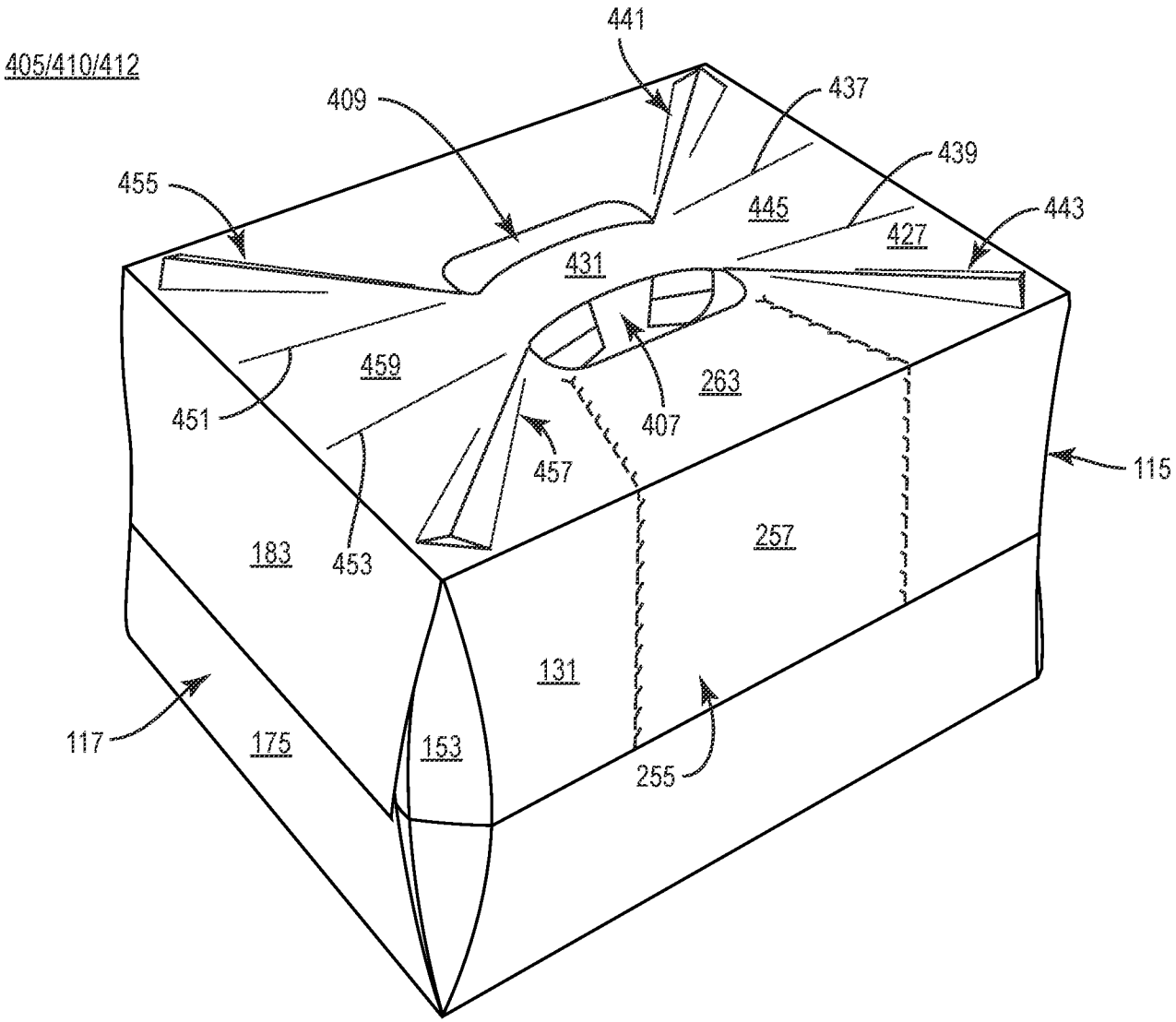
FIG. 9 is a perspective parts-separated view of a portion of the system of FIG. 8 according to the second exemplary embodiment of the disclosure.

With additional reference to FIGS. 8 and 9, the carton 405, construct 605, and reinforced carton 410 can be formed in a manner generally similar to that described above with respect to the carton 105, construct 305, and reinforced carton 110, e.g., by aligning the top panel 427 of the carton blank 403 with the central panel 321 of the reinforcement blank 603, with the end flap 331 of the reinforcement blank 603 generally aligned with the end flap 167 of the carton blank 403, the end flap 335 of the reinforcement blank 603 generally aligned with the end flap 183 of the carton blank 403, the front end flap 365 of the reinforcement blank 603 at least partially aligned with the front panel 131 of the carton blank 603, and with the back end flap 323 of the reinforcement blank 603 at least partially aligned with the back panel 123 of the carton blank 403. Formation of the carton 405/construct 605/reinforced carton 410 can proceed as generally described above with respect to the carton 105/construct 305/reinforced carton 110. The reinforced carton 410 can be provided with one or more containers C as the package 412.

In order to engage the handle 409 of the reinforced carton 410, for example, to lift, carry, or otherwise move the reinforced carton 410, a user can engage the handle flaps 465, 467 to access the interior 407 of the reinforced carton 410. For example, in one embodiment, a user can engage one or more of his or her fingers against one of the handle flaps 465, 467, e.g., so as to cause at least partial separation thereof at a respective cut 469, 471, and the user can engage the other of the handle flaps 465, 467 with one or more of his or her fingers with the same effect.

In some embodiments, the user can insert one or more of his or her fingers through the central portion 477, 493 of a respective handle flap 465, 467 to access the interior 407 of the reinforced carton 410, e.g., by at least partially bisecting the respective central portion 477, 493 at one or more of the respective cuts 469, 487, 488, 471, 503, 504.

In this regard, the user's fingers can be inserted through respective openings formed by the at least partial separation of the respective handle flaps 465, 467, or respective portions thereof, from the remainder of the reinforced carton 410 to engage the handle reinforcement flaps 349, 351 of the construct 605 therebelow. Further movement of the user's fingers can cause the handle reinforcement flaps 349, 351 to at least partially separate from the central panel 321 of the construct 305 at respective portions of the respective lines of weakening 353, 355 and to fold at least partially downwardly relative thereto at respective segments 345*a*, 347*a* of the respective lines of weakening 345, 347.

The user can thus curl his or her fingers about a multi-ply, e.g., four ply, structure formed by the arrangement of, in order from top to bottom: the handle grip portion 431 of the carton 405; the handle grip portion 343 of the construct 305; and the overlapped handle reinforcement flaps 349, 351 (optionally, in either order). In some embodiments, one or more portions of the handle flaps 465, 467 can be at least partially folded into overlapping arrangement with a portion of one or more of the handle grip portion 431, handle grip portion 343, and reinforcement flaps 349, 351.

Accordingly, the handle 409 of the reinforced carton 410 is provided with a reinforced gripping structure about which the user can wrap a portion of his or her hand and/or fingers, e.g., for comfort (so as to avoid pinching), to provide multiple layers of material to avoid the incidence and propagation of tears along the handle 409 and/or other portions of the reinforced carton 410, etc. Such arrangement can obviate the use of other handle reinforcement structures.

Upon further lifting of the handle 405, lifting stresses can be at least partially distributed along the respective handle end portions 445, 459 of the carton 405 and the respective handle end portions 349, 351 of the construct 605 via the arrangement of respective lines of weakening 437, 439, 441, 443, for example, to reduce pressure on the user's hand(s), to inhibit tearing of one or more portions of the reinforced carton 410, etc.

In some embodiments, the lines of weakening 437, 439, 441, 443 can facilitate at least partial pleating (e.g., peaking, overlapping, etc.) of one or more portions of the top panel 421 to facilitate even distribution of lifting stresses on the handle 409.

As also shown, the handle 409 can be arranged so as to restrict access to the containers C in the interior 407 of the reinforced carton 410 until deliberately manipulated by a user.

When it is desired to access one or more containers C in the interior 407 of the reinforced carton 410, a user can activate the dispenser 113 of the reinforced carton 410 in a manner similar to that described above with respect to the reinforced carton 110. In some embodiments, the handle flap 467 can provide the access tab or access feature through which the dispenser panels 255, 361 can be engaged.

The reinforced carton 410 can thus provides a structure with advantages consistent with those described above with respect to the reinforced carton 110.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced carton, comprising:

a carton formed from a first blank, the carton comprising:

a plurality of panels extending at least partially around an interior of the carton, the plurality of panels comprising a top panel, a bottom panel, a front panel, and a back panel;

a plurality of end flaps foldably connected to a respective panel of the plurality of panels of the carton and in at least partially overlapping relation to form at least one closed end of the carton; and handle features at least partially forming a handle of the reinforced carton; and a reinforcement construct formed from a second blank, the reinforcement construct in at least partial face-to-face contact with a portion of the carton, the reinforcement construct comprising:

a central panel; and handle features at least partially forming the handle of the reinforced carton, the handle features of the reinforcement construct comprising at least one handle reinforcement flap foldably connected to the central panel, the handle features of the carton are aligned with the handle features of the reinforcement construct;

wherein the handle features of the carton comprise a handle grip portion at least partially defined in the top panel and the handle features of the reinforcement construct comprise a handle grip portion at least partially defined in the central panel, the handle grip portion in the top panel of the carton overlapping the handle grip portion in the central panel of the reinforcement construct;

wherein a plurality of lines of weakening extend from the handle grip portion in the top panel of the carton to define at least one handle end portion in the carton;

wherein the top panel comprises an attachment feature at least partially separable from the top panel and foldably connected to the at least one handle end portion in the carton.

2. The reinforced carton of claim 1, wherein the at least one reinforcement flap of the reinforcement construct is folded into at least partial face-to-face contact with the handle grip portion in the top panel of the carton.

3. The reinforcement carton of claim 2, wherein the at least one handle reinforcement flap of the reinforcement construct is a first handle reinforcement flap of the reinforcement construct and the reinforcement construct further comprises a second handle reinforcement flap foldably connected to the central panel, the second handle reinforcement flap folded into at least partial face-to-face contact with the first handle reinforcement flap.

4. The reinforced carton of claim 3, wherein the second handle reinforcement flap is in at least partial face-to-face contact with the handle grip portion in the central panel of the reinforcement construct.

5. The reinforced carton of claim 4, wherein the at least one handle end portion of the carton is in at least partial face-to-face contact with at least one handle end portion of the reinforcement construct.

6. The reinforced carton of claim 5, wherein the at least one handle end portion of the carton is at least partially separable from the remainder of the top panel.

7. The reinforced carton of claim 6, wherein the plurality of lines of weakening extending from the handle grip portion in the top panel of the carton extend into at least one end flap of the plurality of end flaps of the carton such that the at least one handle end portion in the carton is at least partially defined in the at least one end flap of the carton, the at least one handle end portion in the carton at least partially separable from the remainder of the at least one end flap of the carton.

8. The reinforced carton of claim 7, wherein the reinforcement construct comprises a plurality of end flaps foldably connected to the central panel, the at least one handle end portion of the reinforcement construct is at least partially defined in at least one end flap of the plurality of end flaps of the reinforcement construct such that the at least one handle end portion of the reinforcement construct is at least partially separable from the remainder of the at least one end flap of the reinforcement construct.

9. The reinforced carton of claim 5, further comprising a dispenser, the dispenser comprising a dispenser panel of the carton at least partially separable from the remainder thereof, the dispenser further comprising a dispenser panel of the reinforcement construct at least partially separable from the remainder thereof, the dispenser panel of the carton in at least partial face-to-face contact with the dispenser panel of the reinforcement construct.

10. The reinforced carton of claim 9, wherein the dispenser panel of the carton is at least partially defined in the top panel and the front panel, the reinforcement construct further comprises at least one end flap foldably connected to the central panel, and the dispenser panel of the reinforcement construct is at least partially defined in the central panel and the at least one end flap of the reinforcement construct.

11. The reinforced carton of claim 5, wherein the carton further comprises container retention features comprising a plurality of container retention flaps foldably connected to at least one end flap of the plurality of end flaps of the carton, the plurality of container retention flaps at least partially separable from the at least one end flap of the carton for at least partially receiving a respective container of the plurality of containers.

12. The reinforced carton of claim 11, wherein the reinforcement construct further comprises a plurality of end flaps foldably connected to the central panel, the reinforcement construct further comprises container retention features comprising at least one container retention opening at least partially defined in at least one end flap of the plurality of end flaps of the reinforcement construct, the at least one container retention opening aligned with the plurality of container retention flaps for at least partially receiving a respective container of the plurality of containers.

13. The reinforced carton of claim 1, wherein the attachment feature is at least partially separable from the top panel at respective cuts and is foldably connected to the top panel and the at least one handle end portion in the carton at respective fold lines extending between the respective cuts.

14. The reinforced carton of claim 1, wherein at least one line of weakening of the plurality of lines of weakening defining the at least one handle end portion extends from the attachment feature.

15. A combination of blanks for forming a reinforced carton, the combination of blanks comprising:

a carton blank for forming a carton, the carton blank comprising:

a plurality of panels for extending at least partially around an interior of the carton formed from the carton blank, the plurality of panels comprising a top panel, a bottom panel, a front panel, and a back panel;

a plurality of end flaps foldably connected to a respective panel of the plurality of panels of the carton blank and for being positioned in at least partially overlapping relation to form at least one closed end of the carton formed from the carton blank; and handle features at least partially forming a handle of the reinforced carton formed from the combination of blanks; and a reinforcement blank for forming a reinforcement construct for being in at least partial face-to-face contact with a portion of the carton formed from the carton blank, the reinforcement blank comprising:

a central panel; and handle features at least partially forming the handle of the reinforced carton formed from the combination of blanks, the handle features of the reinforcement blank comprising at least one handle reinforcement flap foldably connected to the central panel, the handle features of the carton blank are for being aligned with the handle features of the reinforcement blank when the reinforced carton is formed from the combination of blanks;

wherein the handle features of the carton blank comprise a handle grip portion at least partially defined in the top panel and the handle features of the reinforcement blank comprise a handle grip portion at least partially defined in the central panel, the handle grip portion in the top panel of the carton blank for overlapping the handle grip portion in the central panel of the reinforcement blank when the reinforced carton is formed from the combination of blanks;

wherein a plurality of lines of weakening extend from the handle grip portion in the top panel of the carton blank to define at least one handle end portion in the carton blank;

wherein the top panel of the carton blank comprises an attachment feature at least partially separable from the top panel and foldably connected to the at least one handle end portion in the carton blank.

16. The combination of blanks of claim 15, wherein the at least one reinforcement flap of the reinforcement blank is for being folded into at least partial face-to-face contact with the handle grip portion in the top panel of the carton blank when the reinforced carton is formed from the combination of blanks.

17. The combination of blanks of claim 16, wherein the at least one handle reinforcement flap of the reinforcement construct is a first handle reinforcement flap of the reinforcement construct and the reinforcement construct further comprises a second handle reinforcement flap foldably connected to the central panel, the second handle reinforcement flap for being folded into at least partial face-to-face contact with the first handle reinforcement flap when the reinforced carton is formed from the blank.

18. The combination of blanks of claim 17, wherein the at least one handle end portion of the carton blank is positioned in at least partial face-to-face contact with at least one handle end portion of the reinforcement blank when the reinforced carton is formed from the combination of blanks.

19. The combination of blanks of claim 18, wherein the at least one handle end portion of the carton blank is at least partially separable from the remainder of the top panel.

20. The combination of blanks of claim 19, wherein the plurality of lines of weakening extending from the handle grip portion in the top panel of the carton blank extend into at least one end flap of the plurality of end flaps of the carton blank such that the at least one handle end portion in the carton blank is at least partially defined in the at least one end flap of the carton blank, the at least one handle end portion in the carton blank at least partially separable from the remainder of the at least one end flap of the carton blank.

21. The combination of blanks of claim 20, wherein the reinforcement blank comprises a plurality of end flaps foldably connected to the central panel, the at least one handle end portion of the reinforcement blank is at least partially defined in at least one end flap of the plurality of end flaps of the reinforcement blank such that the at least one handle end portion of the reinforcement blank is at least partially separable from the remainder of the at least one end flap of the reinforcement blank.

22. The combination of blanks of claim 18, further comprising dispenser features, the dispenser features comprising a dispenser panel of the carton blank at least partially separable from the remainder thereof, the dispenser features further comprising a dispenser panel of the reinforcement blank at least partially separable from the remainder thereof, the dispenser panel of the carton blank for being positioned in at least partial face-to-face contact with the dispenser panel of the reinforcement blank when the reinforced carton is formed from the combination of blanks.

23. The combination of blanks of claim 22, wherein the dispenser panel of the carton blank is at least partially defined in the top panel and the front panel, the reinforcement blank further comprises at least one end flap foldably connected to the central panel, and the dispenser panel of the reinforcement blank is at least partially defined in the central panel and the at least one end flap of the reinforcement blank.

24. The combination of blanks of claim 18, wherein the carton blank further comprises container retention features comprising a plurality of container retention flaps foldably connected to at least one end flap of the plurality of end flaps of the carton blank, the plurality of container retention flaps at least partially separable from the at least one end flap of the carton blank for at least partially receiving a respective container of the plurality of containers.

25. The combination of blanks of claim 24, wherein the reinforcement blank further comprises a plurality of end flaps foldably connected to the central panel, the reinforcement blank further comprises container retention features comprising at least one container retention opening at least partially defined in at least one end flap of the plurality of end flaps of the reinforcement blank, the at least one container retention opening aligned with the plurality of container retention flaps for at least partially receiving a respective container of the plurality of containers.

26. The combination of blanks of claim 15, wherein the attachment feature is at least partially separable from the top panel at respective cuts and is foldably connected to the top panel and the at least one handle end portion in the carton at respective fold lines extending between the respective cuts.

27. The combination of blanks of claim 15, wherein at least one line of weakening of the plurality of lines of weakening defining the at least one handle end portion extends from the attachment feature.

28. A method of forming a reinforced carton, the method comprising:

obtaining a carton blank comprising a plurality of panels comprising a top panel, a bottom panel, a front panel, and a back panel, a plurality of end flaps foldably connected to a respective panel of the plurality of panels of the carton blank, and handle features;

obtaining a reinforcement blank comprising a central panel and handle features comprising at least one handle reinforcement flap foldably connected to the central panel;

folding the plurality of panels of the carton blank at least partially around an interior of the reinforced carton;

forming a reinforcement construct from the construct blank;

positioning the reinforcement construct in at least partial face-to-face contact with a portion of the carton;

aligning the handle features of the carton with the handle features of the reinforcement construct to form a handle of the reinforced carton; and at least partially overlapping the plurality of end flaps of the carton blank to form at least one closed end of the reinforced carton;

wherein the handle features of the carton comprise a handle grip portion at least partially defined in the top panel and the handle features of the reinforcement construct comprise a handle grip portion at least partially defined in the central panel, and aligning the handle features comprises overlapping the handle grip portion in the top panel of the carton with the handle grip portion in the central panel of the reinforcement construct;

wherein a plurality of lines of weakening extend from the handle grip portion in the top panel of the carton blank to define at least one handle end portion in the carton formed from the carton blank;

wherein the top panel comprises an attachment feature at least partially separable from the top panel and foldably connected to the at least one handle end portion in the carton.

29. The method of claim 28, further comprising folding the at least one reinforcement flap of the reinforcement construct into at least partial face-to-face contact with the handle grip portion in the top panel of the carton.

30. The method of claim 29, wherein the at least one handle reinforcement flap of the reinforcement construct is a first handle reinforcement flap of the reinforcement construct and the reinforcement construct further comprises a second handle reinforcement flap foldably connected to the central panel, and the method further comprises folding the second handle reinforcement flap into at least partial face-to-face contact with the first handle reinforcement flap.

31. The method of claim 30, wherein the second handle reinforcement flap is folded into at least partial face-to-face contact with the handle grip portion in the central panel of the reinforcement construct.

32. The method of claim 31, further comprising positioning the at least one handle end portion of the carton in at least partial face-to-face contact with at least one handle end portion of the reinforcement construct.

33. The method of claim 32, wherein the at least one handle end portion of the carton is at least partially separable from the remainder of the top panel.

34. The method of claim 33, wherein the plurality of lines of weakening extending from the handle grip portion in the top panel of the carton extend into at least one end flap of the plurality of end flaps of the carton such that the at least one handle end portion in the carton is at least partially defined in the at least one end flap of the carton, the at least one handle end portion in the carton at least partially separable from the remainder of the at least one end flap of the carton.

35. The method of claim 34, wherein the reinforcement construct comprises a plurality of end flaps foldably connected to the central panel, the at least one handle end portion of the reinforcement construct is at least partially defined in at least one end flap of the plurality of end flaps of the reinforcement construct such that the at least one handle end portion of the reinforcement construct is at least partially separable from the remainder of the at least one end flap of the reinforcement construct.

36. The method of claim 32, wherein the carton blank further comprises dispenser features for at least partially forming a dispenser and the reinforcement blank comprises dispenser features for at least partially forming a dispenser, the dispenser features of the carton blank comprising a dispenser panel of the carton at least partially separable from the remainder thereof, the dispenser features of the reinforcement blank comprising a dispenser panel of the reinforcement construct at least partially separable from the remainder thereof, and the method comprises positioning the dispenser panel of the carton blank in at least partial face-to-face contact with the dispenser panel of the reinforcement blank to form the dispenser of the reinforced carton.

37. The method of claim 36, wherein the dispenser panel of the carton blank is at least partially defined in the top panel and the front panel, the reinforcement blank further comprises at least one end flap foldably connected to the central panel, and the dispenser panel of the reinforcement blank is at least partially defined in the central panel and the at least one end flap of the reinforcement construct.

38. The method of claim 32, wherein the carton blank further comprises container retention features comprising a plurality of container retention flaps foldably connected to at least one end flap of the plurality of end flaps of the carton, the plurality of container retention flaps at least partially separable from the at least one end flap of the carton blank for at least partially receiving a respective container of the plurality of containers.

39. The method of claim 38, wherein the reinforcement blank further comprises a plurality of end flaps foldably connected to the central panel, the reinforcement blank further comprises container retention features comprising at least one container retention opening at least partially defined in at least one end flap of the plurality of end flaps of the reinforcement blank, and the method comprises aligning the at least one container retention opening with the plurality of container retention flaps for at least partially receiving a respective container of the plurality of containers.

* * * * *